US008196805B2

(12) United States Patent
Brand et al.

(10) Patent No.: US 8,196,805 B2
(45) Date of Patent: Jun. 12, 2012

(54) CARTONS WITH LIQUID-TIGHT RECEPTACLES

(75) Inventors: Kirsten Laura Brand, Marietta, GA (US); Jean-Manuel Gomes, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 634 days.

(21) Appl. No.: 11/750,697

(22) Filed: May 18, 2007

(65) Prior Publication Data

US 2007/0267466 A1 Nov. 22, 2007

Related U.S. Application Data

(60) Provisional application No. 60/801,525, filed on May 18, 2006.

(51) Int. Cl.
*B65D 5/56* (2006.01)
*B65D 17/00* (2006.01)
*B65D 5/00* (2006.01)

(52) U.S. Cl. ..... 229/117.32; 229/101; 229/122.32; 229/225

(58) Field of Classification Search ..... 229/117.32, 229/225, 117.27, 164.2, 122.31, 117.28
See application file for complete search history.

(56) References Cited

U.S. PATENT DOCUMENTS 499,655 A 6/1893 Clark
1,145,668 A 7/1915 Brown
1,478,791 A 12/1923 Nelson
1,503,161 A 7/1924 Hornecker
1,564,374 A 12/1925 Smith
1,634,073 A 6/1927 LaBombarde
1,656,919 A 1/1928 Marsh
1,762,703 A 6/1930 Smith
1,762,704 A 6/1930 Smith
1,772,625 A 8/1930 Caulfield
1,844,751 A 2/1932 Freedman et al.
1,869,751 A 8/1932 Iacobitti
1,901,483 A 3/1933 Ware, Jr.
1,911,215 A 5/1933 Walter
1,925,102 A 9/1933 Levkoff
1,951,408 A 3/1934 Haven
1,971,863 A 8/1934 Lupton
2,005,924 A 6/1935 Wilson
2,006,203 A 6/1935 Leslie
2,027,079 A 1/1936 Weiss
2,098,818 A 11/1937 Andrews
2,141,743 A 12/1938 Ethridge
(Continued)

FOREIGN PATENT DOCUMENTS

CH 692 649 A5 9/2002
(Continued)

OTHER PUBLICATIONS

PCT/US2007/011906—Communication Relating to the Results of the Partial International Search.
(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

Cartons include liquid-tight vessels that line the interior volumes of the cartons. The cartons may have selected sections reinforced by one or more reinforcing blanks.

33 Claims, 25 Drawing Sheets

U.S. PATENT DOCUMENTS

| | | | | | |
|---|---|---|---|---|---|
| 2,145,430 | A | | 1/1939 | New | |
| 2,152,079 | A | | 3/1939 | Mott | |
| 2,196,243 | A | | 4/1940 | Bensel | |
| 2,290,971 | A | | 7/1942 | King | |
| 2,330,294 | A | | 9/1943 | Leavitt et al. | |
| 2,343,222 | A | | 2/1944 | Nelson | |
| 2,345,486 | A | | 3/1944 | Leebov | |
| 2,346,134 | A | | 4/1944 | Kirkland et al. | |
| 2,348,377 | A | | 5/1944 | Goodyear | |
| 2,355,665 | A | | 8/1944 | Mabee | |
| 2,365,159 | A | | 12/1944 | Walton | |
| 2,383,853 | A | | 8/1945 | Guyer | |
| 2,407,781 | A | | 9/1946 | Guyer | |
| 2,407,802 | A | | 9/1946 | Stotter | |
| 2,416,332 | A | | 2/1947 | Lehman | |
| 2,437,926 | A | | 3/1948 | Ball | |
| 2,502,117 | A | | 3/1950 | Anderson | |
| 2,576,594 | A | | 11/1951 | Goldstein | |
| 2,643,589 | A | | 6/1953 | Weiss | |
| 2,679,349 | A | | 5/1954 | Mullinix | |
| 2,701,679 | A | | 2/1955 | Goldstein | |
| 2,706,076 | A | | 4/1955 | Guyer | |
| 2,710,134 | A | | 6/1955 | Schroeder et al. | |
| 2,775,393 | A | | 12/1956 | Rugg | |
| 2,778,557 | A | | 1/1957 | Moore | |
| 2,791,362 | A | | 5/1957 | Nute | |
| 2,810,506 | A | | 10/1957 | Kessler | |
| 2,848,151 | A | | 8/1958 | O'Neil | |
| 2,868,433 | A | | 1/1959 | Anderson, Jr. | |
| 2,875,938 | A | | 3/1959 | Bramhill | |
| 2,933,228 | A | | 4/1960 | Guyer | |
| 2,934,251 | A | | 4/1960 | Kramer | |
| 2,944,726 | A | | 7/1960 | McCauley | |
| 2,955,739 | A | | 10/1960 | Collura | |
| 2,967,610 | A | | 1/1961 | Ebert et al. | |
| 2,973,086 | A | | 2/1961 | Thompson | |
| 2,993,632 | A | | 7/1961 | De Feo | |
| 3,002,613 | A | | 10/1961 | Merkel et al. | |
| 3,021,002 | A | | 1/1962 | Reynolds | |
| 3,033,362 | A | | 5/1962 | Marcalus | |
| 3,048,324 | A | | 8/1962 | Anderson | |
| 3,090,483 | A | | 5/1963 | Altree et al. | |
| 3,092,301 | A | | 6/1963 | Selle | |
| 3,094,266 | A | | 6/1963 | Hoff | |
| 3,112,856 | A | | 12/1963 | MacIntosh et al. | |
| 3,116,866 | A | | 1/1964 | Boran | |
| 3,137,437 | A | | 6/1964 | Svensson | |
| 3,157,342 | A | | 11/1964 | Grady | |
| 3,158,312 | A | | 11/1964 | Simkins | |
| 3,159,326 | A | | 12/1964 | Stonebanks | |
| 3,184,136 | A | | 5/1965 | Forbes, Jr. | |
| 3,189,251 | A | * | 6/1965 | McFarland | 229/235 |
| 3,265,283 | A | | 8/1966 | Farquhar | |
| 3,276,665 | A | | 10/1966 | Rasmussen | |
| 3,280,968 | A | | 10/1966 | Craine | |
| 3,355,089 | A | | 11/1967 | Champlin | |
| 3,363,822 | A | | 1/1968 | Maulini et al. | |
| 3,414,182 | A | | 12/1968 | Fobiano | |
| 3,417,911 | A | | 12/1968 | Hennessey | |
| 3,426,955 | A | | 2/1969 | Olson | |
| 3,434,648 | A | | 3/1969 | Du Barry, Jr. | |
| 3,443,971 | A | * | 5/1969 | Wood | 426/124 |
| 3,561,667 | A | * | 2/1971 | Saltman | 229/117.32 |
| 3,574,040 | A | | 4/1971 | Chitwood | |
| 3,621,628 | A | | 11/1971 | Chidsey, Jr. | |
| 3,640,447 | A | | 2/1972 | Forbes, Jr. et al. | |
| 3,653,495 | A | | 4/1972 | Gray | |
| 3,669,345 | A | | 6/1972 | Cole | |
| 3,677,458 | A | | 7/1972 | Gosling | |
| 3,680,766 | A | | 8/1972 | Collura et al. | |
| 3,690,544 | A | | 9/1972 | Meyers | |
| 3,744,702 | A | * | 7/1973 | Ellison | 229/122.32 |
| 3,750,538 | A | | 8/1973 | Confer | |
| 3,759,378 | A | | 9/1973 | Werth | |
| 3,768,719 | A | | 10/1973 | Johnson | |
| 3,786,914 | A | | 1/1974 | Beutler | |
| 3,831,836 | A | | 8/1974 | Ellison et al. | |
| 3,880,341 | A | * | 4/1975 | Bamburg et al. | 229/122.32 |
| 3,884,348 | A | | 5/1975 | Ross | |
| 3,891,137 | A | | 6/1975 | Ellison | |
| 3,905,646 | A | | 9/1975 | Brackmann et al. | |
| 3,951,333 | A | | 4/1976 | Forbes, Jr. et al. | |
| 3,981,430 | A | | 9/1976 | Keim | |
| 4,008,849 | A | | 2/1977 | Baber | |
| 4,015,768 | A | | 4/1977 | McLennan | |
| 4,027,794 | A | | 6/1977 | Olson | |
| 4,036,423 | A | | 7/1977 | Gordon | |
| 4,046,307 | A | | 9/1977 | Booth et al. | |
| 4,059,220 | A | | 11/1977 | Lorenz | |
| 4,095,735 | A | | 6/1978 | Stone | |
| 4,113,100 | A | | 9/1978 | Soja et al. | |
| 4,141,485 | A | | 2/1979 | Lambert | |
| 4,165,030 | A | | 8/1979 | Bunger et al. | |
| 4,168,003 | A | | 9/1979 | Wysocki | |
| 4,194,677 | A | | 3/1980 | Wysocki | |
| 4,308,956 | A | | 1/1982 | Steinke et al. | |
| 4,328,923 | A | | 5/1982 | Graser | |
| 4,341,338 | A | | 7/1982 | Arnold | |
| 4,344,537 | A | | 8/1982 | Austin | |
| 4,345,393 | A | | 8/1982 | Price et al. | |
| 4,371,109 | A | | 2/1983 | Tanner et al. | |
| 4,378,905 | A | | 4/1983 | Roccaforte | |
| 4,380,314 | A | | 4/1983 | Langston, Jr. et al. | |
| 4,458,810 | A | | 7/1984 | Mahoney | |
| 4,484,683 | A | | 11/1984 | Werner, Jr. | |
| 4,498,619 | A | | 2/1985 | Roccaforte | |
| 4,508,218 | A | | 4/1985 | Focke et al. | |
| 4,512,476 | A | | 4/1985 | Herrington, Jr. | |
| 4,519,538 | A | | 5/1985 | Omichi | |
| 4,546,914 | A | | 10/1985 | Roccaforte | |
| 4,548,318 | A | | 10/1985 | Boyle | |
| 4,558,785 | A | | 12/1985 | Gordon | |
| 4,566,593 | A | | 1/1986 | Muller | |
| 4,572,423 | A | | 2/1986 | Spencer | |
| 4,586,643 | A | | 5/1986 | Halabisky et al. | |
| 4,588,084 | A | | 5/1986 | Holley, Jr. | |
| 4,608,038 | A | | 8/1986 | Virta et al. | |
| 4,645,108 | A | | 2/1987 | Gavin et al. | |
| 4,676,394 | A | | 6/1987 | Hiersteiner et al. | |
| 4,742,917 | A | | 5/1988 | Bornwasser | |
| 4,746,019 | A | | 5/1988 | Prater | |
| 4,760,952 | A | | 8/1988 | Wachter | |
| 4,768,703 | A | | 9/1988 | Sosler et al. | |
| 4,773,541 | A | | 9/1988 | Riddell | |
| 4,778,057 | A | | 10/1988 | Allen et al. | |
| 4,781,317 | A | | 11/1988 | Ditto | |
| 4,793,550 | A | | 12/1988 | Gottlieg | |
| 4,804,138 | A | | 2/1989 | McFarland | |
| 4,815,609 | A | | 3/1989 | Kiedaisch | |
| 4,863,052 | A | | 9/1989 | Lambert | |
| 4,865,187 | A | | 9/1989 | Zulauf et al. | |
| 4,886,160 | A | | 12/1989 | Kilgerman | |
| 642,121 | A | | 1/1990 | Hildreth | |
| 4,905,898 | A | | 3/1990 | Wade | |
| 4,909,395 | A | | 3/1990 | Weissman | |
| 4,911,177 | A | | 3/1990 | Truc et al. | |
| 4,913,292 | A | | 4/1990 | Field | |
| 4,919,269 | A | | 4/1990 | Wright et al. | |
| 4,946,093 | A | * | 8/1990 | Moorman | 229/125.19 |
| 4,946,540 | A | | 8/1990 | Mitchard | |
| 4,948,033 | A | | 8/1990 | Halsell, II et al. | |
| 4,989,735 | A | | 2/1991 | O'Brien | |
| 5,012,929 | A | | 5/1991 | Roosa | |
| 5,012,959 | A | | 5/1991 | Gordon | |
| 5,020,337 | A | | 6/1991 | Krieg | |
| 5,050,742 | A | | 9/1991 | Muckenfuhs | |
| 5,069,359 | A | | 12/1991 | Liebel | |
| 5,071,010 | A | | 12/1991 | Carufel/Zeman | |
| 5,072,876 | A | | 12/1991 | Wilson | |
| 5,083,667 | A | | 1/1992 | Holder | |
| 5,092,516 | A | | 3/1992 | Kastanekak | |
| 5,094,359 | A | | 3/1992 | DeMars et al. | |
| 5,125,568 | A | | 6/1992 | Bauer | |
| 5,129,875 | A | | 7/1992 | Chaygneaud-Dupuy | |
| 5,141,150 | A | | 8/1992 | Plaessmann | |
| 5,181,650 | A | | 1/1993 | Hollander et al. | |
| 5,222,660 | A | | 6/1993 | Koss | |

| | | | | |
|---|---|---|---|---|
| 5,238,181 | A | | 8/1993 | Mahler |
| 5,251,808 | A | | 10/1993 | Rudd |
| 5,285,956 | A | | 2/1994 | Piepho |
| 5,292,058 | A | | 3/1994 | Zoss et al. |
| 5,328,091 | A | | 7/1994 | Koss |
| 5,347,865 | A | | 9/1994 | Mulry et al. |
| 5,351,849 | A | * | 10/1994 | Jagenburg et al. ..... 229/117.3 |
| 5,356,022 | A | | 10/1994 | Tipps |
| 5,373,960 | A | | 12/1994 | Gunn et al. |
| 5,386,937 | A | | 2/1995 | Crawford |
| 5,429,297 | A | | 7/1995 | Walsh |
| 5,450,680 | A | | 9/1995 | Bromberg |
| 5,495,727 | A | | 3/1996 | Strong et al. |
| 5,505,372 | A | | 4/1996 | Edson et al. |
| 5,544,806 | A | | 8/1996 | Anderson et al. |
| 5,551,938 | A | | 9/1996 | Stone |
| 5,582,343 | A | | 12/1996 | Dalvey |
| 5,584,430 | A | | 12/1996 | Mulry |
| 5,588,585 | A | | 12/1996 | McClure |
| 5,599,267 | A | | 2/1997 | Dupey |
| 5,601,521 | A | | 2/1997 | Plamas Xapelli |
| 5,632,402 | A | | 5/1997 | Walsh et al. |
| 5,632,404 | A | | 5/1997 | Walsh |
| 5,639,017 | A | | 6/1997 | Fogle |
| 5,678,755 | A | | 10/1997 | Block |
| 5,699,957 | A | | 12/1997 | Blin et al. |
| 5,709,766 | A | | 1/1998 | Press et al. |
| 5,746,871 | A | | 5/1998 | Walsh |
| 5,757,930 | A | | 5/1998 | Seidemann et al. |
| 5,775,576 | A | | 7/1998 | Stone |
| 5,783,030 | A | | 7/1998 | Walsh |
| 5,794,811 | A | | 8/1998 | Walsh |
| 5,794,812 | A | | 8/1998 | Walsh |
| 5,796,778 | A | | 8/1998 | Harris |
| 5,810,250 | A | | 9/1998 | Stone et al. |
| 5,826,783 | A | | 10/1998 | Stout |
| 5,842,576 | A | | 12/1998 | Snow |
| 5,857,570 | A | | 1/1999 | Brown |
| 5,857,614 | A | | 1/1999 | Walsh |
| 5,873,515 | A | | 2/1999 | Dunn et al. |
| 5,881,884 | A | | 3/1999 | Podosek |
| 5,893,513 | A | | 4/1999 | Stone et al. |
| 5,915,546 | A | | 6/1999 | Harrelson |
| 5,918,799 | A | | 7/1999 | Walsh |
| 5,921,398 | A | | 7/1999 | Carroll |
| 5,927,498 | A | | 7/1999 | Saam |
| 5,960,555 | A | | 10/1999 | Deaton et al. |
| 5,967,374 | A | | 10/1999 | Baker |
| 5,979,749 | A | | 11/1999 | Bozich |
| 5,992,733 | A | | 11/1999 | Gomes |
| 5,996,797 | A | | 12/1999 | Flaig |
| D419,440 | S | | 1/2000 | Hansen |
| 6,015,084 | A | | 1/2000 | Mathieu et al. |
| 6,027,017 | A | | 2/2000 | Kuhn et al. |
| 6,027,018 | A | | 2/2000 | Yocum |
| 6,059,182 | A | | 5/2000 | Wein |
| 6,065,590 | A | | 5/2000 | Spivey |
| 6,102,277 | A | | 8/2000 | Kraphol, Sr. |
| 6,110,095 | A | | 8/2000 | Finke et al. |
| 6,129,211 | A | | 10/2000 | Prakken et al. |
| 6,131,729 | A | | 10/2000 | Eckermann et al. |
| 6,135,289 | A | | 10/2000 | Miller |
| 6,145,736 | A | | 11/2000 | Ours et al. |
| 6,158,653 | A | | 12/2000 | Kanter et al. |
| 6,164,526 | A | | 12/2000 | Dalvey |
| 6,189,777 | B1 | | 2/2001 | Hutchinson et al. |
| 6,221,192 | B1 | | 4/2001 | Walsh |
| 6,230,881 | B1 | | 5/2001 | Collura |
| 6,332,488 | B1 | | 12/2001 | Walsh |
| 6,352,096 | B1 | | 3/2002 | Walsh |
| 6,364,202 | B1 | | 4/2002 | Zelley |
| 6,386,639 | B1 | | 5/2002 | Yuhas et al. |
| 6,419,152 | B1 | | 7/2002 | Tokarski |
| 6,435,402 | B1 | | 8/2002 | Hengami |
| 6,478,159 | B1 | | 11/2002 | Taylor et al. |
| 6,510,982 | B2 | | 1/2003 | White |
| 6,523,692 | B2 | | 2/2003 | Gregory |
| 6,568,586 | B1 | | 5/2003 | Van Esley |
| 6,631,803 | B2 | | 10/2003 | Rhodes et al. |
| 6,689,034 | B2 | | 2/2004 | Walsh |
| 6,729,475 | B2 | | 5/2004 | Yuhas et al. |
| 6,761,269 | B2 | | 7/2004 | Hamming |
| 6,854,639 | B2 | | 2/2005 | Walsh |
| 6,869,009 | B2 | | 3/2005 | Sutherland et al. |
| 6,889,892 | B2 | | 5/2005 | Walsh et al. |
| 6,905,027 | B2 | | 6/2005 | Galter |
| 6,913,189 | B2 | | 7/2005 | Oliff et al. |
| 6,918,487 | B2 | | 7/2005 | Harrelson |
| 6,926,193 | B2 | | 8/2005 | Smalley |
| 6,948,293 | B1 | | 9/2005 | Eckermann et al. |
| 6,997,316 | B2 | | 2/2006 | Sutherland |
| 7,021,468 | B2 | | 4/2006 | Cargile, Jr. |
| 7,025,504 | B2 | | 4/2006 | Olin |
| 7,201,714 | B2 | | 4/2007 | Zoeckler et al. |
| 7,407,087 | B2 | | 8/2008 | DeBusk et al. |
| 7,658,318 | B2 | | 2/2010 | Walsh et al. |
| 7,699,215 | B2 | | 4/2010 | Spivey, Sr. |
| 7,717,322 | B2 | | 5/2010 | Walsh et al. |
| 7,762,394 | B2 | | 7/2010 | Bradford et al. |
| 2001/0048022 | A1 | | 12/2001 | Zoeckler |
| 2002/0022560 | A1 | | 2/2002 | Zoeckler |
| 2002/0036153 | A1 | | 3/2002 | Yang |
| 2002/0055429 | A1 | | 5/2002 | Walsh |
| 2002/0060240 | A1 | | 5/2002 | Walsh |
| 2002/0170845 | A1 | | 11/2002 | Oliff |
| 2003/0144121 | A1 | | 7/2003 | Walsh et al. |
| 2003/0226879 | A1 | | 12/2003 | Auclair et al. |
| 2004/0007614 | A1 | | 1/2004 | Saulas |
| 2004/0226989 | A1 | | 11/2004 | Cook et al. |
| 2005/0092649 | A1 | | 5/2005 | Ford et al. |
| 2005/0103681 | A1 | | 5/2005 | Aubry et al. |
| 2005/0109827 | A1 | | 5/2005 | Martin |
| 2005/0133579 | A1 | * | 6/2005 | Smorch et al. ..... 229/225 |
| 2005/0167291 | A1 | | 8/2005 | Sutherland |
| 2005/0187087 | A1 | | 8/2005 | Walsh |
| 2005/0218203 | A1 | | 10/2005 | Harrelson |
| 2006/0049067 | A1 | | 3/2006 | McDonald |
| 2006/0243783 | A1 | | 11/2006 | Spivey, Sr. et al. |
| 2006/0255105 | A1 | | 11/2006 | Sweet |
| 2006/0255107 | A1 | | 11/2006 | Wright |
| 2006/0266815 | A1 | | 11/2006 | Coltri-Johnson et al. |
| 2006/0268810 | A1 | | 11/2006 | Foushee |
| 2006/0273143 | A1 | | 12/2006 | Finch |
| 2007/0000984 | A1 | | 1/2007 | McClure |
| 2007/0051781 | A1 | | 3/2007 | Holley, Jr. |
| 2007/0080199 | A1 | | 4/2007 | Sutherland |
| 2007/0131749 | A1 | | 6/2007 | Coltri-Johnson et al. |

FOREIGN PATENT DOCUMENTS

| | | |
|---|---|---|
| CH | 692649 | 9/2002 |
| DD | 94 13 813 U1 | 8/1994 |
| DE | 1091851 | 10/1960 |
| DE | 2 320 190 | 4/1973 |
| DE | 29 23 455 | 6/1979 |
| DE | 81 10 323.9 | 4/1981 |
| DE | 87 08 078.8 | 6/1987 |
| DE | 3627019 | 2/1988 |
| DE | 8908393 | 9/1989 |
| DE | 29703082 | 2/1997 |
| DE | 298 17 195 U1 | 9/1998 |
| DE | 20216854 U1 | 11/2002 |
| DE | 102005005500 | 3/2006 |
| DE | 102005053561 | 3/2006 |
| EP | 0079155 | 5/1983 |
| EP | 0133595 | 6/1984 |
| EP | 0542449 | 5/1993 |
| EP | 0704386 | 3/1996 |
| EP | 1457425 | 9/2004 |
| EP | 08010412 | 11/2008 |
| FR | 1379931 | 12/1963 |
| FR | 2699150 | 12/1992 |
| FR | 2686316 | 7/1993 |
| FR | 2755670 | 5/1998 |
| FR | 2882032 | 8/2006 |
| GB | 104445 | 6/1916 |
| GB | 1218016 | 4/1967 |
| GB | 1242356 | 1/1969 |
| GB | 1489963 | 10/1975 |

| | | | |
|---|---|---|---|
| GB | 1584066 | | 2/1981 |
| GB | 2275913 | | 9/1994 |
| GB | 2 361 000 | A | 10/2001 |
| GB | 2363372 | | 12/2001 |
| GB | 2379923 | | 3/2003 |
| JP | 44-25911 | | 10/1969 |
| JP | 57123729 | | 8/1982 |
| JP | 59-181025 | | 12/1984 |
| JP | 53-39118 | | 3/2010 |
| WO | WO 92/01606 | | 2/1992 |
| WO | WO 95/28325 | | 10/1995 |
| WO | WO 97/27114 | | 7/1997 |
| WO | WO 98/31593 | | 7/1998 |
| WO | WO 02/11516 | | 2/2002 |
| WO | WO 03/051622 | | 6/2003 |
| WO | WO 03/082686 | | 10/2003 |
| WO | WO 2004/063031 | | 7/2004 |
| WO | WO 2006/133401 | | 12/2006 |
| WO | WO 2007/089282 | | 8/2007 |

OTHER PUBLICATIONS

Communication regarding partial ISR for Application No. PCTUS20070011906.

ISR—WO for Application No. PCTUS2008071307.

ISR—WO for Application No. PCTUS2006039865.

EP Search Report for Application No. EP 0801412.8.

* cited by examiner

CARTONS WITH LIQUID-TIGHT RECEPTACLES

PRIORITY APPLICATION

This application claims the benefit of U.S. Provisional Application No. 60/801,525, filed May 18, 2006, which is hereby incorporated by reference in its entirety.

RELATED APPLICATION

This application is related to U.S. application Ser. No. 11/612,103, entitled "COLLAPSIBLE COOLER PACK WITH BARRIER FILM," filed Dec. 18, 2006, which is hereby incorporated by reference in its entirety.

BACKGROUND

Dispensing cartons are known. Conventional dispensing cartons may have a top panel with a dispensing feature formed therein. Such cartons may be used to contain articles such as beverage containers, for example, that are dispensable through the top panel or through another panel when the carton is opened. Typically, conventional cartons must be refrigerated in order to keep the enclosed containers cool. When the cartons are no longer refrigerated, such as when the carton is removed from the refrigerator to dispense the containers, the containers may become undesirably warm. The containers must then be refrigerated again or otherwise cooled. Further, the dispensing features included in conventional cartons may render the cartons incapable of being securely reclosed once opened. Articles retained within the carton may therefore inadvertently fall out of the carton once the carton has been opened.

Conventional cartons are typically formed from a single ply of paperboard or similar material. Carrying handles may be formed in one or more panels of the carton and used to carry the carton. Because cartons are often used to carry relatively heavy articles, such as beverage containers, the strength of the handles or other sections of the cartons must be increased in order to accommodate the carton load. A conventional method for increasing the load-bearing capacity of a paperboard carton is to produce the carton from a blank of a different, stronger paperboard material, or to produce the blank from the same carton material but having greater thickness or caliper. Such conventional methods typically increase the costs associated with manufacturing the carton, with the material costs of manufacture generally increasing according to the cost of increasing the strength and/or thickness of the entire blank. Some sections of the blank, however, may not be load-bearing, and the additional costs associated with increasing the strength of non-load bearing sections of the blank are wasted.

SUMMARY

According to a first embodiment of the invention, a carton comprises a bottom closure, a first side panel, a second side panel, a first end panel, and a second end panel, wherein the side and end panels and the bottom closure define in part an interior volume of the carton. A liquid-tight vessel is attached to at least a portion of the interior surface of the carton and provides a liquid-tight lining for at least a portion of the interior volume of the carton.

According to an aspect of the first embodiment, a top of the carton can be opened and ice, cold water, additional containers, and/or other articles can be placed in the carton through the opened top end. The interior volume of the carton can be used to retain liquids, such as water resulting from melting ice, condensation, other liquids, and articles such as, for example, refuse, particulate matter, etc.

According to another aspect of the invention, a carton can be formed from a multi-ply blank comprising a major blank and one or more minor blanks. The minor blanks may be configured to render the carton multi-ply at selected sections. A minor blank may be used, for example, to reinforce the major blank so as to increase the strength and/or load-bearing capacity of the multi-ply carton. The minor blank can be configured to reinforce the major blank at any number of desired locations. Selected reinforcement of specific areas of the major blank can produce a high strength carton having a high load-bearing capacity while using relatively small amounts of paperboard or other materials of construction.

According to another aspect of the invention, the minor blank can be at least partially unfolded to place the carton in an expanded configuration. The height of the carton interior, and concomitantly the interior volume of the carton, are increased in the expanded configuration. The increased interior volume of the carton can be used to accommodate items such as, for example, additional containers or ice within the carton. The liquid-tight vessel can be adhered to the carton interior surface adjacent to an upper edge of the minor blank so that substantially all of the interior volume of the carton is liquid-tight.

Other aspects, features, and details of the present invention can be more completely understood by reference to the following detailed description, taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The first embodiment of the invention relates to a carton suitable for storing and dispensing articles such as, for example, beverage containers. The carton provides a receptacle suitable for accommodating, for example, liquids, ice, or other coolants in the carton. The receptacle may be, for example, liquid-tight. In one exemplary embodiment, ice can be added to the opened carton to cool articles held within the carton. As the ice melts, all or a part of the resultant runoff water may be held within the liquid-tight receptacle. One or more reinforcing minor blanks can be included, for example, to increase the strength of selected portions of the carton so as to increase the load-bearing capacity of the carton, to allow for an increase in an interior volume of the carton, to provide a reclosable lid, or to provide other advantages.

Articles accommodated within the present carton embodiments can include containers such as, for example, petaloid bottle containers, beverage cans, glass or plastic bottles, or other containers such as, for example, those used in the packaging of foodstuffs. For the purposes of illustration and not for the purpose of limiting the scope of the present invention, the following detailed description describes beverage bottles as disposed within the illustrated cartons. In this specification, the terms "side," "bottom," "lower," "upper" and "top" indicate orientations determined in relation to fully erected, upright cartons. In this specification, the terms "end" and "side" are used for ease of reference, and do not imply relative sizes of panels or flaps.

Figure 1A:
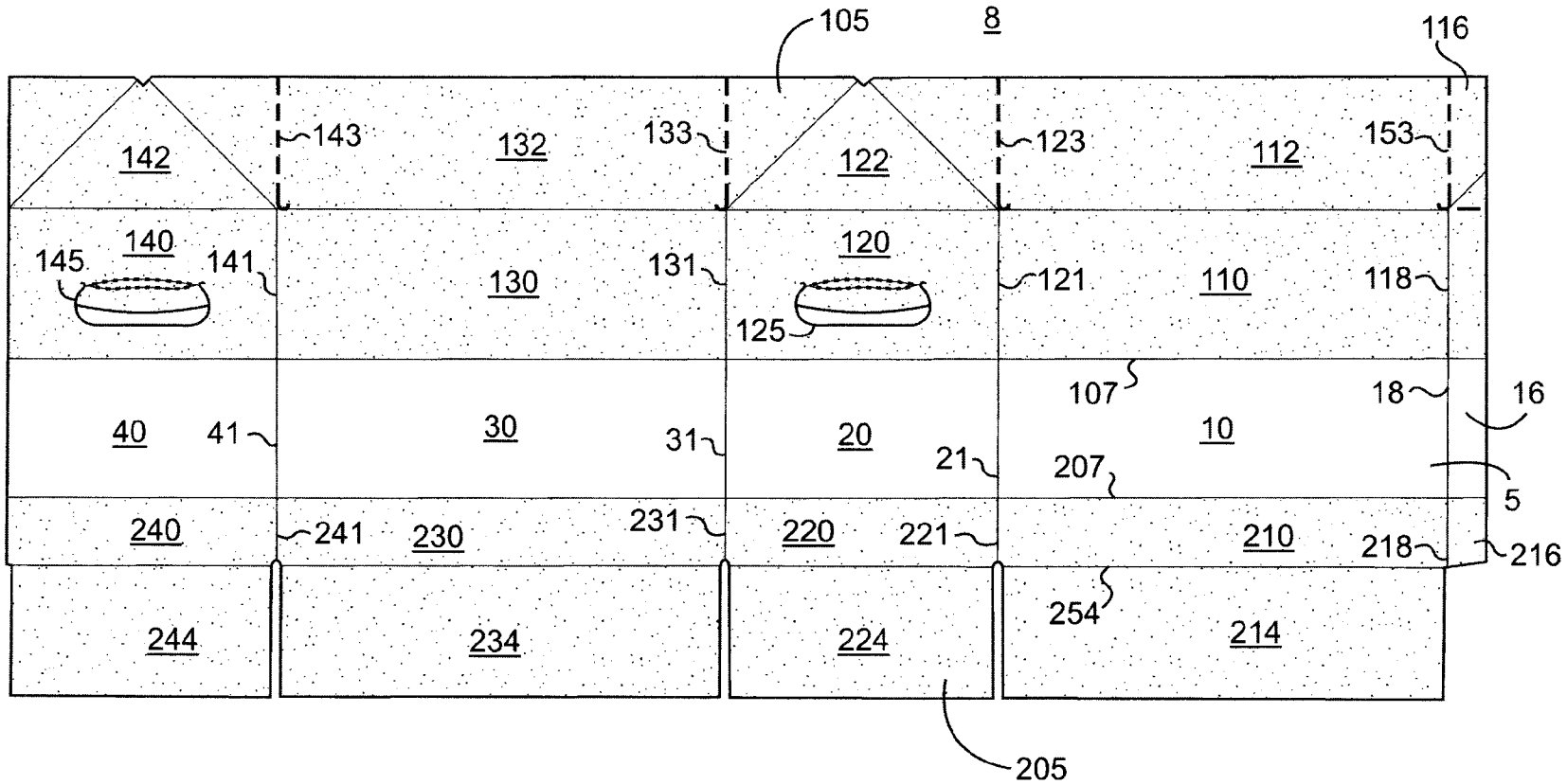
FIG. 1A is a plan view of a multi-ply blank used to form a carton according to a first embodiment of the invention.

FIG. 1A is a plan view of a multi-ply blank 8 used to form a carton 280 (illustrated in FIG. 7) according to the first embodiment of the invention. The multi-ply blank 8 is formed from a major blank 5 and upper and lower minor blanks 105, 205, respectively, that are adhered, laminated, or otherwise joined to the interior side of the major blank 5. The interior or underside surface of the major blank 5, with the minor blanks 105, 205 adhered thereto, is visible in FIG. 1A. In the drawing figures of this specification, the surface of the minor blanks 105, 205 are shaded with stippling solely to distinguish the minor blanks 105, 205 from the major blank 5, which is not stippled. In the illustrated embodiment, the minor blanks 105, 205 are adhered to the interior side of the major blank 5, although they may be adhered to the exterior or print side.

Figure 1B:
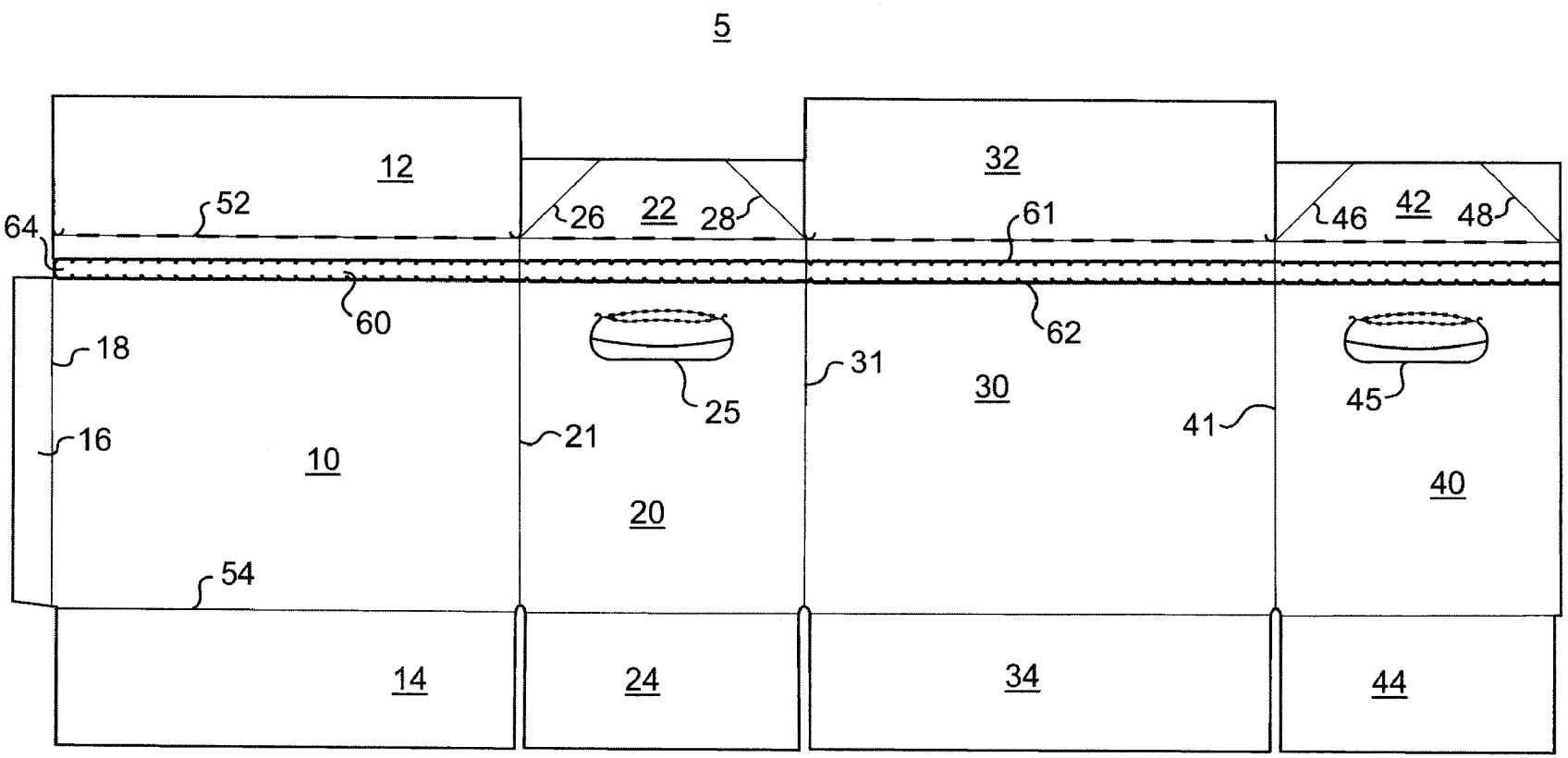
FIG. 1B is a plan view of a major blank of the multi-ply blank illustrated in FIG. 1A.
Figure 1C:
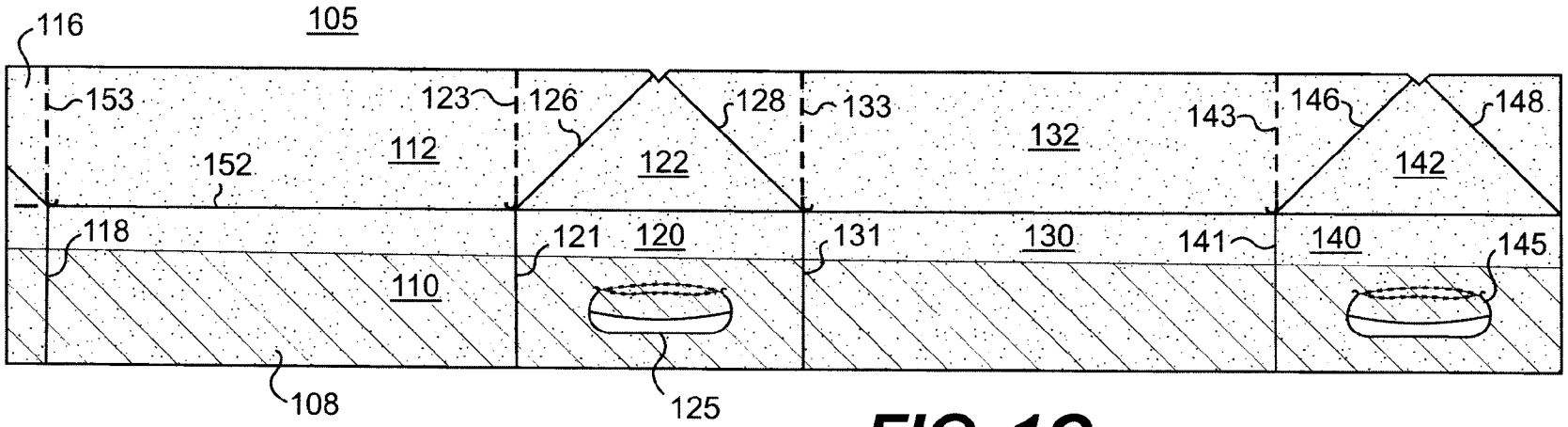
FIG. 1C is a plan view of a first minor blank of the multi-ply blank illustrated in FIG. 1A.
Figure 1D:
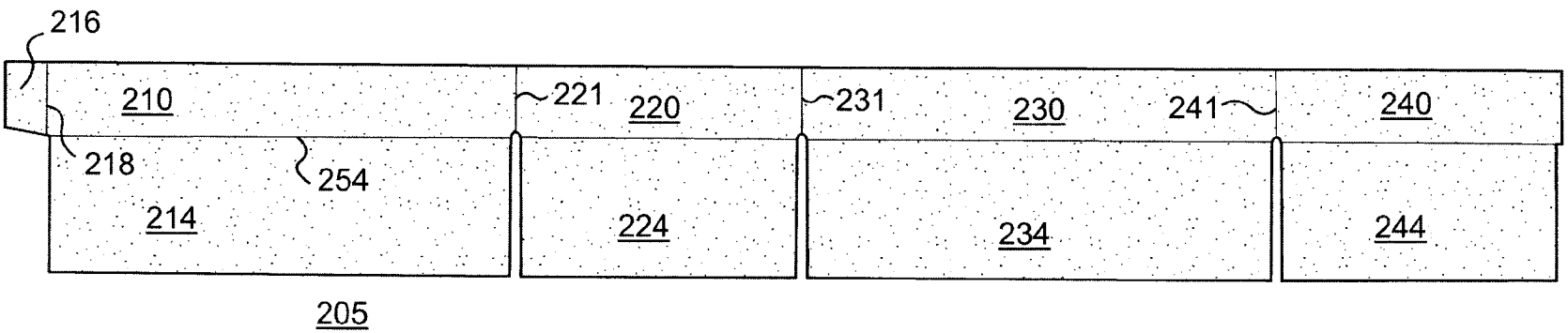
FIG. 1D is a plan view of a second minor blank of the multi-ply blank illustrated in FIG. 1A.

The multi-ply blank 8 is "multi-ply" in that the joined blank plies 5, 105, 205 comprising the multi-ply blank 8 include substantial overlapping portions. Also, a majority of the overlapping surfaces of the major blank 5 and the minor blank plies 105, 205 may be adhered adjacent to one another. The minor blanks 105, 205 have different perimeters or "footprints" and need not overlap at all points with the major blank 5. The individual plies comprising the multi-ply blank 8 are illustrated in FIGS. 1B-1D. FIG. 1B is a plan view of the exterior or print side of the major blank 5, FIG. 1C is a plan view of the upper minor blank 105, and FIG. 1D is a plan view of the lower minor blank 205.

Referring to FIG. 1B, the major blank 5 comprises a first side panel 10, a first end panel 20 foldably connected to the first side panel 10 at a transverse fold line 21, a second side panel 30 foldably connected to the first end panel 20 at a transverse fold line 31, and a second end panel 40 foldably connected to the second side panel 30 at a transverse fold line 41. An adhesive flap 16 may be foldably connected to the first side panel 10 at a transverse fold line 18.

Still referring to FIG. 1B, a first side top flap 12 of the major blank 5 is foldably connected to the first side panel 10 at a cut-crease longitudinal fold line 52 and a first side bottom flap 14 is foldably connected to the first side panel 10 at a longitudinal fold line 54. A first end top flap 22 is foldably connected to the first end panel 20 at the longitudinal fold line 52 and a first end bottom flap 24 is foldably connected to the first end panel 20 at the longitudinal fold line 54. A second side top flap 32 is foldably connected to the second side panel 30 at the longitudinal fold line 52 and a second side bottom flap 34 is foldably connected to the second side panel 30 at the longitudinal fold line 54. A second end top flap 42 is foldably connected to the second end panel 40 at the longitudinal fold line 52 and a second end bottom flap 44 is foldably connected to the second end panel 40 at the longitudinal fold line 54. The longitudinal fold lines 52, 54 may be straight fold lines, or may be offset at one or more locations to account for, for example, blank thickness. The top flaps 12, 22, 32, 42 extend along a first or upper marginal area of the major blank 5. The bottom flaps 14, 24, 34, 44 extend along a second or lower marginal area of the major blank 5. As shown in FIG. 1B, the longitudinal fold line 54 may be interrupted at the transverse fold lines 21, 31, 41.

Figure 7:
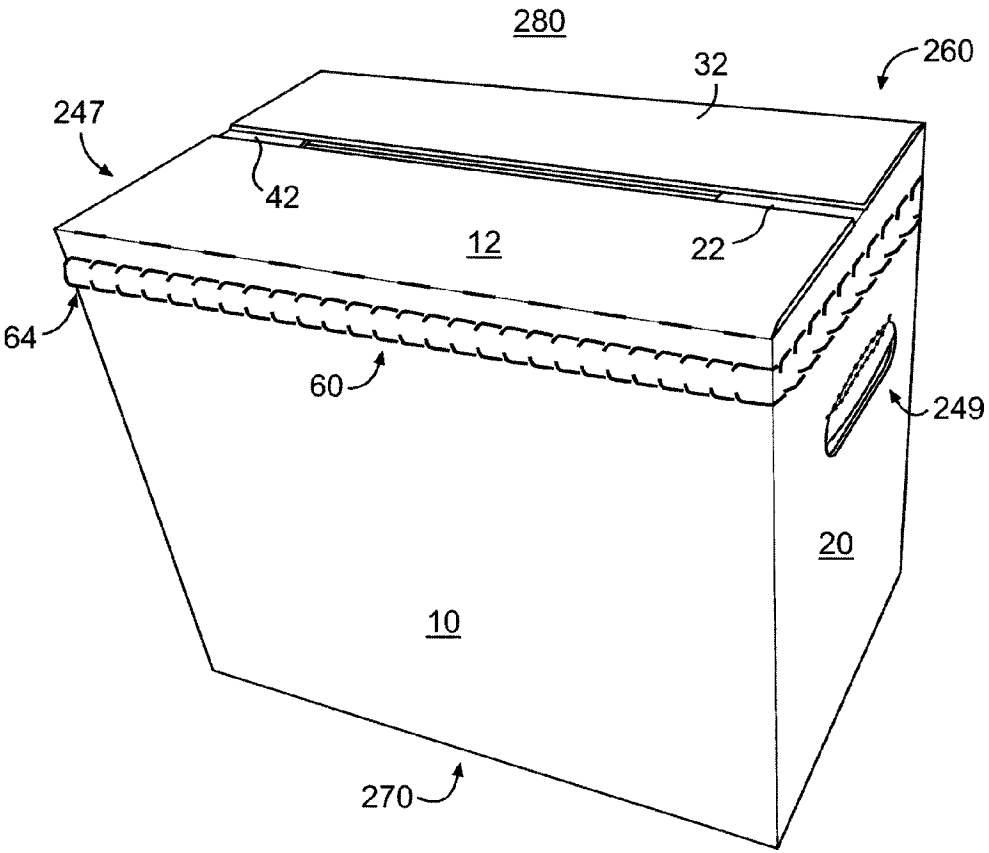
FIG. 7 illustrates the erected first carton embodiment with containers accommodated therein.

A handle feature 25 is formed in the first end panel 20 and a similar handle feature 45 is formed in the second end panel 40. The first end top flap 22 may include oblique fold or crease lines 26, 28 extending from the longitudinal fold line 52 to a top edge of the first top end flap 22. The second end top flap 42 may include oblique fold or crease lines 46, 48 extending from the longitudinal fold line 52 to the top edge of the second top end flap 42. The oblique fold lines 26, 28, 46, 48 facilitate closure of a top of the major blank 5 during erection of the carton 280 (FIG. 7).

A longitudinal tear strip 60 is defined by spaced tear lines 61, 62 extending the length of the major blank 5 through the panels 10, 20, 30, 40. The tear strip 60 allows a top of the carton 280 to be opened, as discussed in further detail below.

FIG. 1C illustrates the side of the upper minor blank 105 that is adhered to the interior or underside surface of the major blank 5 illustrated in FIG. 1B. The opposite side of the upper minor blank 105 faces the interior of the carton 280 (FIG. 7) formed from the multi-ply blank 8. Overlapping elements in the blanks 5, 105 are indicated by similar reference numbers, with reference numbers in the upper minor blank 105 being preceded by a "1."

Referring to FIG. 1C, the upper minor blank 105 comprises a first side panel 110, a first end panel 120 foldably connected to the first side panel 110 at a transverse fold line 121, a second side panel 130 foldably connected to the first end panel 120 at a transverse fold line 131, and a second end panel 140 foldably connected to the second side panel 130 at a transverse fold line 141. An adhesive flap 116 may be foldably connected to the first side panel 110 at a transverse fold line 118. A first side top flap 112 is foldably connected to the first side panel 110 at a longitudinal fold line 152. A first end top flap 122 is foldably connected to the first end panel 120 at the longitudinal fold line 152. A second side top flap 132 is foldably connected to the second side panel 130 at the longitudinal fold line 152. A second end top flap 142 is foldably connected to the second end panel 140 at the longitudinal fold line 152. The first side top flap 112 may be foldably connected to the adhesive flap 116 at a transverse cut-space fold line 153 and to the first end top flap 122 at a transverse cut-space fold line 123. The second side top flap 132 may be foldably connected to the first end top flap 122 at a transverse cut-space fold line 133 and to the second end top flap 142 at a transverse cut-space fold line 143. The top flaps 112, 122, 132, 142 extend along an upper marginal area of the upper minor blank 105. In the multi-ply blank 8, the top flaps 112, 122, 132, 142 at least partially overlap the top flaps 12, 22, 32, 42 in the major blank 5 (FIG. 1B).

Figure 8:
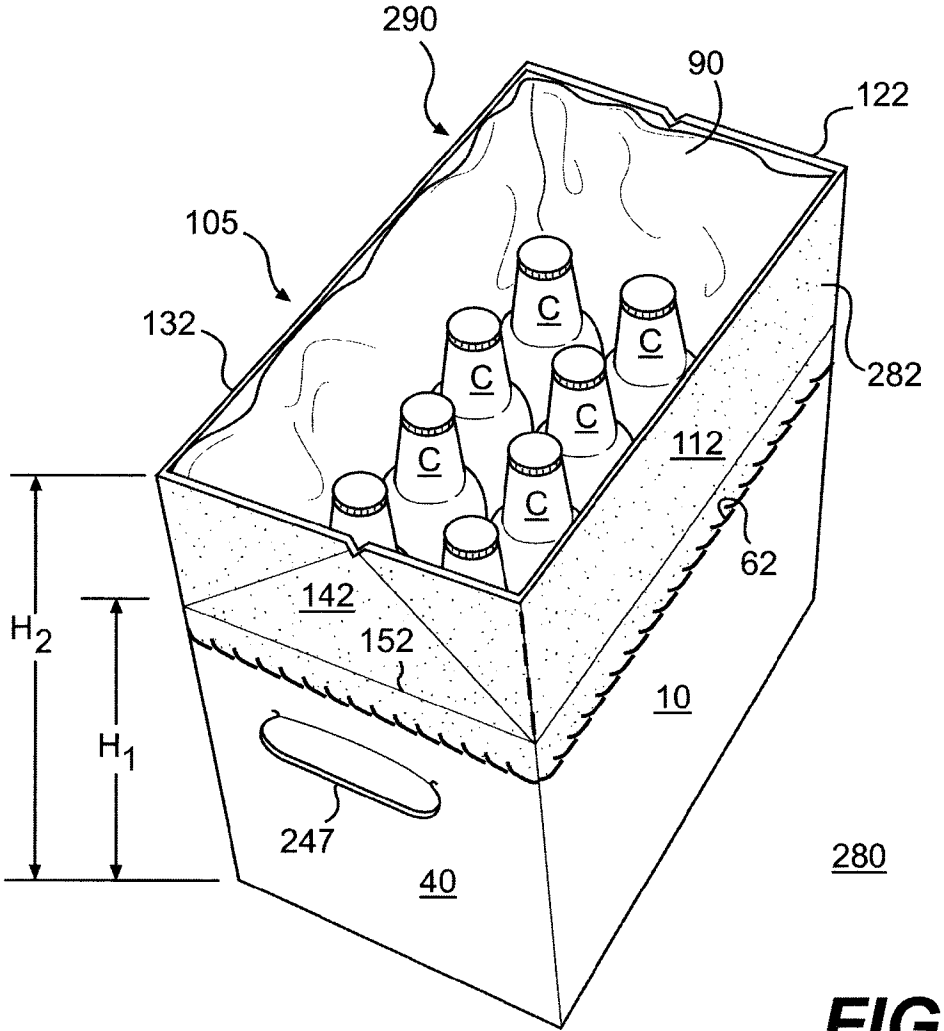
FIG. 8 illustrates the first carton embodiment with the top of the carton opened.

Still referring to FIG. 1C, a handle feature 125 is formed in the first end panel 120 and a similar handle feature 145 is formed in the second end panel 140. In the multi-ply blank 8, the handle features 125, 145 overlap and cooperate with the handle features 25, 45, respectively, in the major blank 5 (FIG. 1B). The first end top flap 122 may include oblique fold or crease lines 126, 128 extending from the longitudinal fold line 152 to a top edge of the first end top flap 122. The second end top flap 142 may include oblique fold or crease lines 146, 148 extending from the longitudinal fold line 152 the top edge of the second end top flap 142. The oblique fold lines 126, 128, 146, 148 facilitate closure of a top of the upper minor blank 105 during erection of the carton 280 (FIG. 7) and facilitate expansion of the carton interior carton volume (FIG. 8).

FIG. 1D illustrates the side of the lower minor blank 205 that is adhered to the major blank 5 illustrated in FIG. 1B. The opposite side of the lower minor blank 205 faces the interior of the carton 280 (FIG. 7). Overlapping features in the blanks 5, 205 are indicated by similar reference numbers, with reference numbers in the lower minor blank 205 preceded by a "2."

Referring to FIG. 1D, the lower minor blank 205 comprises a first side panel 210, a first end panel 220 foldably connected to the first side panel 210 at a transverse fold line 221, a second side panel 230 foldably connected to the first end panel 220 at a transverse fold line 231, and a second end panel 240 foldably connected to the second side panel 230 at a transverse fold line 241. An adhesive flap 216 may be foldably connected to the first side panel 210 at a transverse fold line 218. A first side bottom flap 214 is foldably connected to the first side panel 210 at a longitudinal fold line 254. A first end bottom flap 224 is foldably connected to the first end panel 220 at the longitudinal fold line 254. A second side bottom flap 234 is foldably connected to the second side panel 230 at the longitudinal fold line 254. A second end bottom flap 244 is foldably connected to the second end panel 240 at the longitudinal fold line 254. The bottom flaps 114, 224, 234, 244 extend along a lower marginal area of the lower minor blank 205. The bottom flaps 214, 224, 234, 244 at least partially overlap the bottom flaps 14, 24, 34, 44, respectively, in the major blank 5 (FIG. 1B).

Referring to FIGS. 1A-1D, the multi-ply blank 8 may be constructed by adhering the upper minor blank 105 and the lower minor blank 205 to the interior side of the major blank 5, as shown in FIG. 1A. Each of the panels 110, 120, 130, 140 of the upper minor blank 105 may be adhered to a corresponding panel 10, 20, 30, 40 respectively, of the major blank 5, in the crosshatched area 108 shown in FIG. 1C. The upper minor blank 105 may be adhered to the major blank 5, for example, below the tear strip 60. The lower minor blank 205 can be adhered to the major blank 5 so that each panel or flap 210, 220, 230, 240, 216, 214, 224, 234, 244 of the lower minor blank 205 is adhered to a corresponding panel or flap 10, 20, 30, 40, 16, 14, 24, 34, 44, respectively, of the major blank 5. Glue strips, applied hot melt glue, lamination processes, or other adhesives and means can be used to adhere the major and minor blanks 5, 105, 205 together.

Figure 1E:
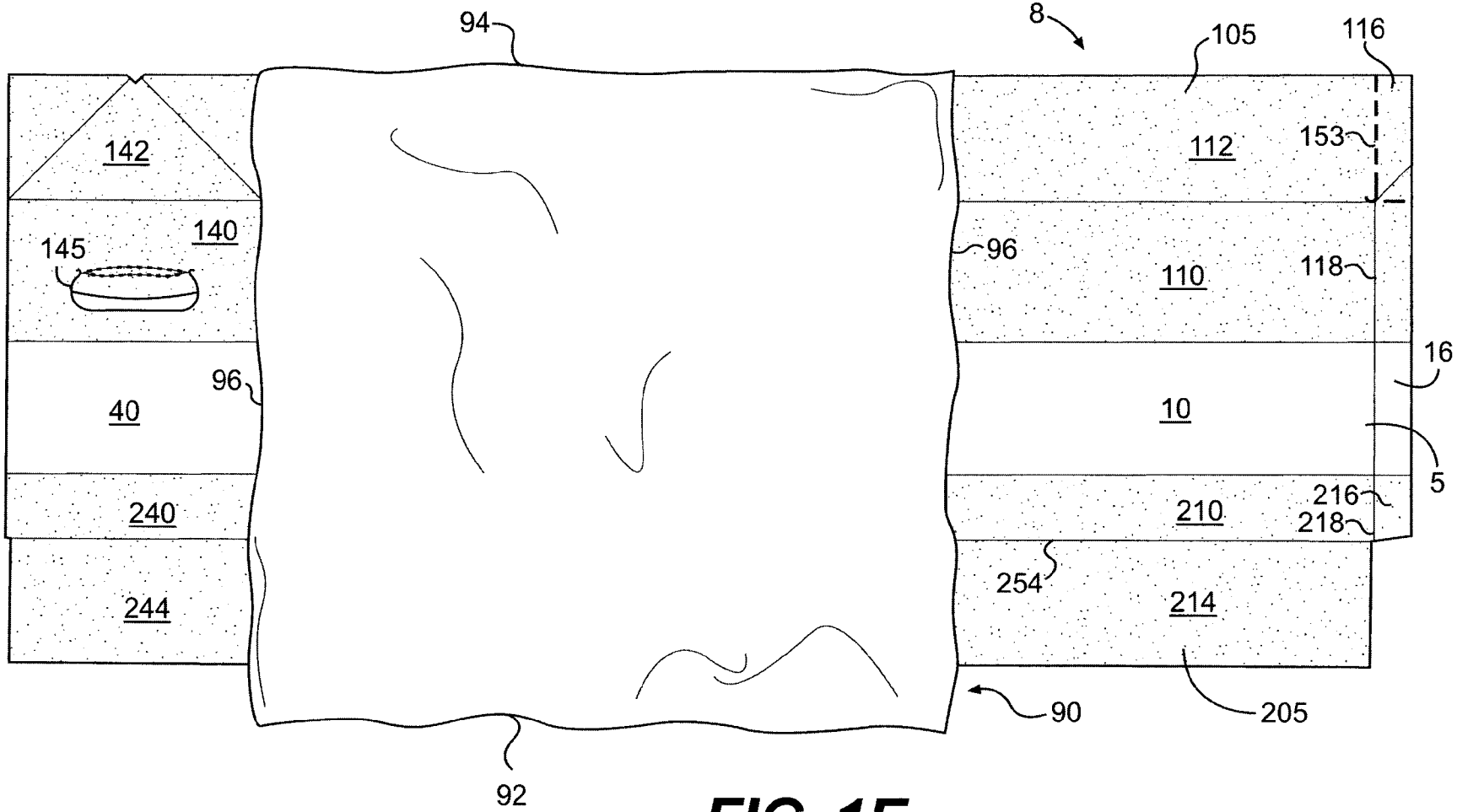
FIG. 1E illustrates application of a liquid-tight vessel to the blank of FIG. 1A.

Referring to FIG. 1E, a liquid-tight receptacle or vessel 90 is placed on the interior side of the multi-ply blank 8. The liquid-tight vessel, or "bag" 90 has sealed portions 92, 96 and an open top portion 94 through which articles can be placed in the vessel. The liquid-tight vessel 90 can be adhered to, for example, one or more locations of the panels 10, 110, 210, 20, 120, 220, 30, 130, 230, 40, 140, 240. In one embodiment, it is sufficient to adhere the liquid-tight vessel 90 to the upper minor blank 105, such as at an upper edge of the blank 105. The liquid-tight vessel 90 may be joined to the blank 8 so that when the blank 8 is opened to a generally tubular form, the open top portion 94 of the liquid-tight vessel 90 is supported in an open position by its adherence to the interior surface of the blank 8. The liquid-tight vessel 90 can be formed from, for example, any liquid-tight material. For example, a flexible liquid-tight material such as plastic may be used to form the vessel 90. In the illustrated exemplary embodiment, the vessel 90 is a plastic bag.

An exemplary method of erection of the multi-ply blank 8 and liquid-tight vessel 90 into the carton 280 and loading of the carton will now be discussed with reference to FIGS. 1A-7.

Figure 2:
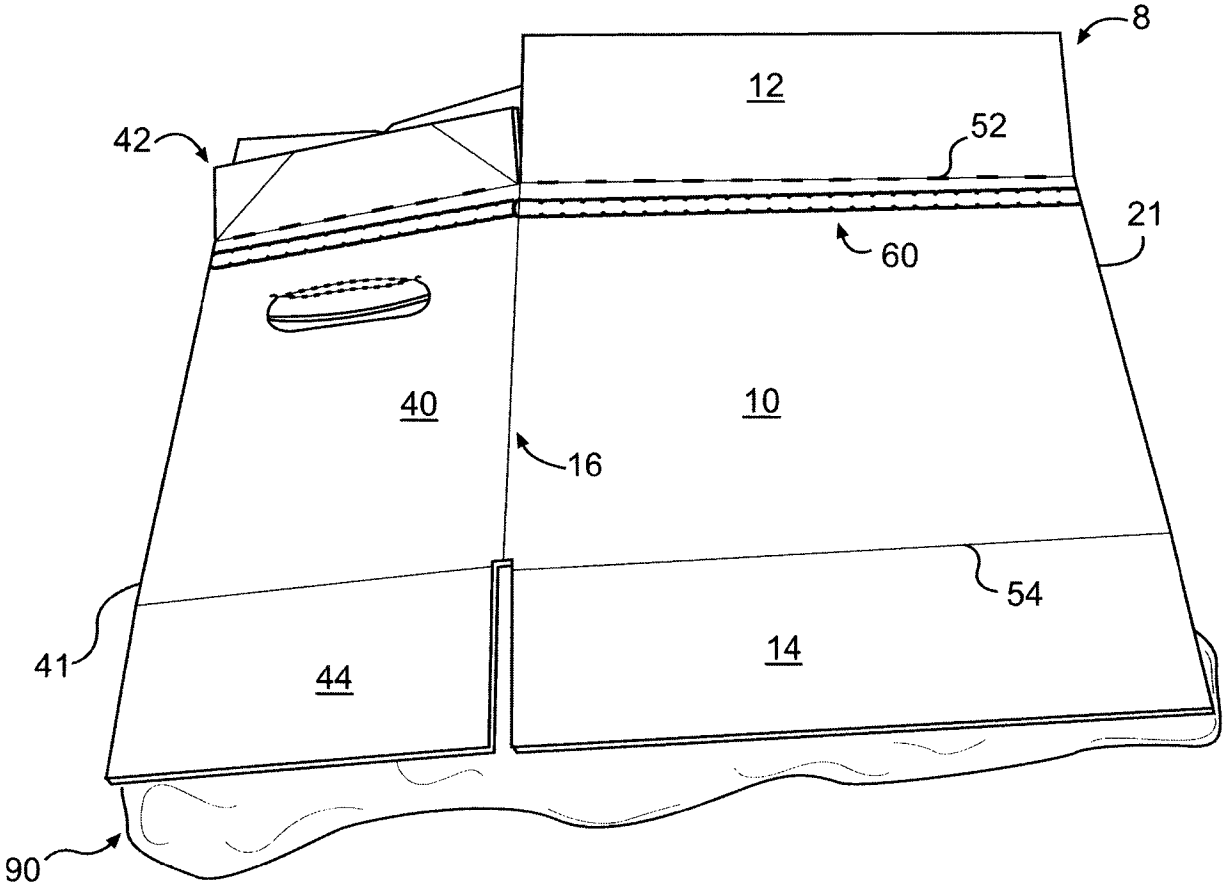
FIG. 2 illustrates an erection step of the first carton embodiment.

Referring to FIGS. 1A-1E and specifically to FIG. 2, the multi-ply blank 8 is folded about the transverse fold lines 21, 41 in the major blank 5 and about the corresponding transverse fold lines 121, 221, 141, 241 in the minor blanks 105, 205 so that the exterior side of the adhesive flap 16 of the major blank 5 is adhered to the interior sides of the second end panels 40, 140, 240 in the blanks 5, 105, 205, respectively. Also, the exterior side of the adhesive flap 116 (FIG. 1C) of the upper minor blank 105 is adhered to the interior side of the second end top flap 142. Folding of the blank 8 as shown in FIG. 2 can also serve to press the interior surfaces of the blank 8 against the vessel 90 so that the vessel is adhered thereto. The bag/blank combination article shown in FIG. 2 has a substantially flat tubular shape, with the vessel accommodated therein, that may be shipped to a location for distribution to a consumer, packaging facility, retailer, etc. The consumer can later form the article into a carton. The generally flat closed tubular configuration allows the article to be easily stored and transported.

Figure 3:
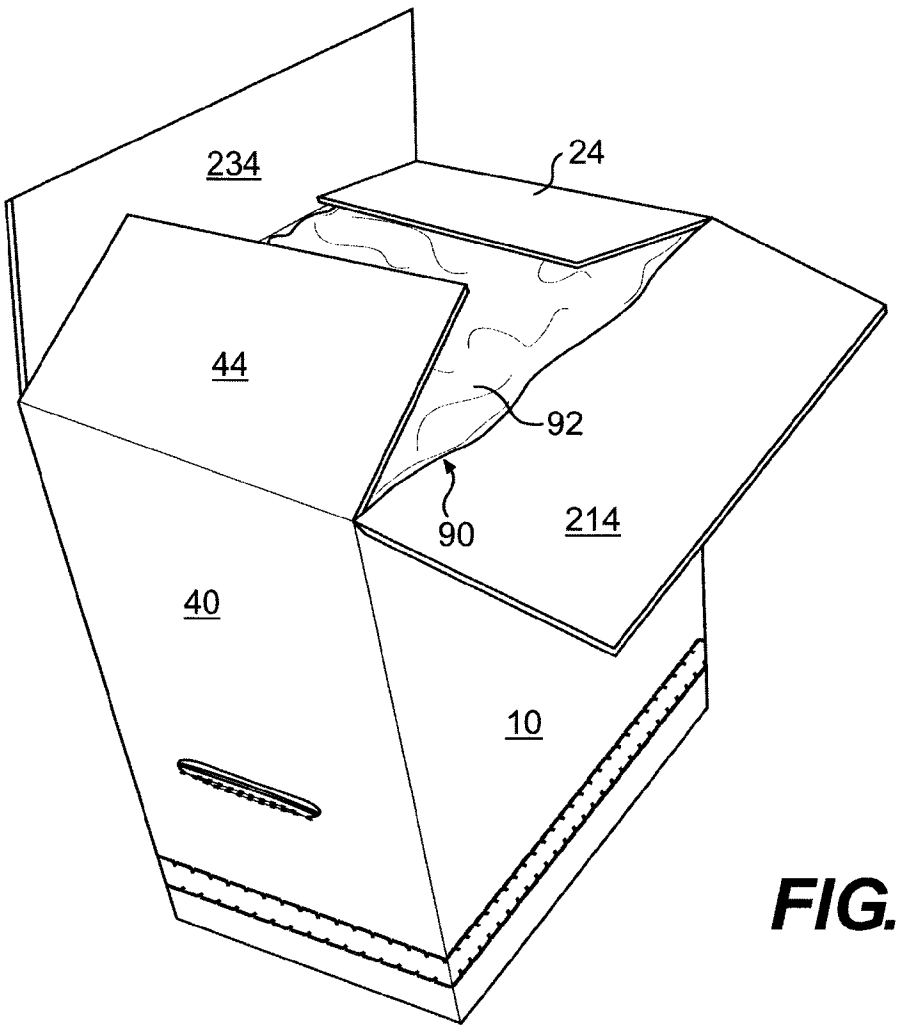
FIG. 3 illustrates an erection step of the first carton embodiment.

FIG. 3 illustrates the bottom end of the partially erected blank 8, with the liquid-tight vessel 90 accommodated therein. In FIG. 3, the folded and glued blank 8 is opened into a generally tubular form. Opening the blank 8 as shown in FIG. 3 also expands or opens up the liquid-tight vessel 90 adhered to the interior surface of the blank 8. The bottom of the partially erected carton may be closed by folding the overlapping bottom flaps 24, 224 and 44, 244 over the open bottom end, and applying adhesive to the exterior sides of the bottom flaps 22, 44. The interior sides of the bottom flaps 234, 214 may then be adhered to the exterior sides of the bottom flaps 24, 44.

Figure 4:
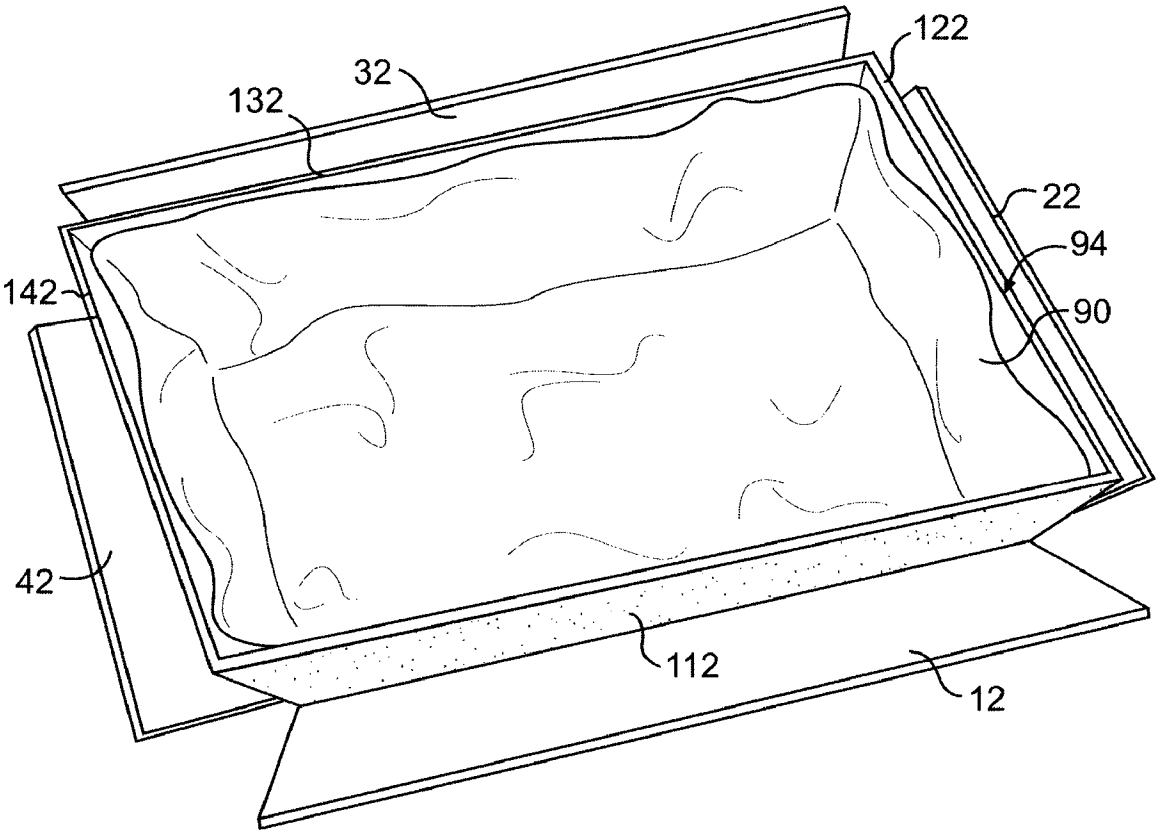
FIG. 4 illustrates an erection step of the first carton embodiment.
Figure 5:
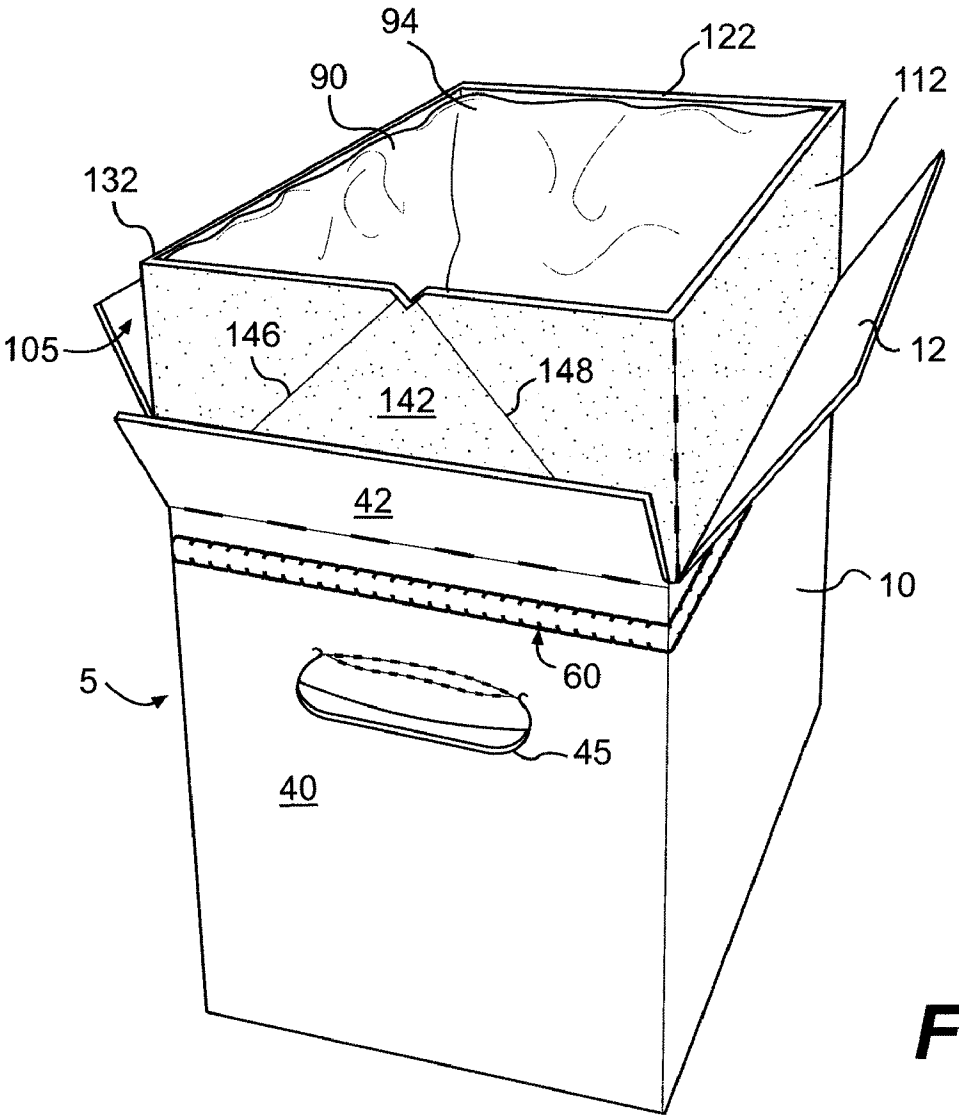
FIG. 5 illustrates an erection step of the first carton embodiment.

FIG. 4 illustrates the open top end of the partially erected carton. In general, the open top portion 94 of the liquid-tight vessel 90 opens when the blank 8 is opened to the tubular form. If desired, the vessel 90 may be pressed against adhesive located on the interior sides of the partially erected carton at this time in order to further secure the vessel 90 to the interior of the carton. The vessel 90 may also be placed in the carton without using adhesive. In the illustrated embodiment, the liquid-tight vessel 90 is adhered at least to the upper minor blank 105 adjacent to the upper edge of the upper minor blank 105. Referring to FIG. 5, the vessel 90 within the partially erected carton is supported in an opened state so that the open end of the vessel can receive articles such as containers C (shown in FIG. 8).

Figure 6:
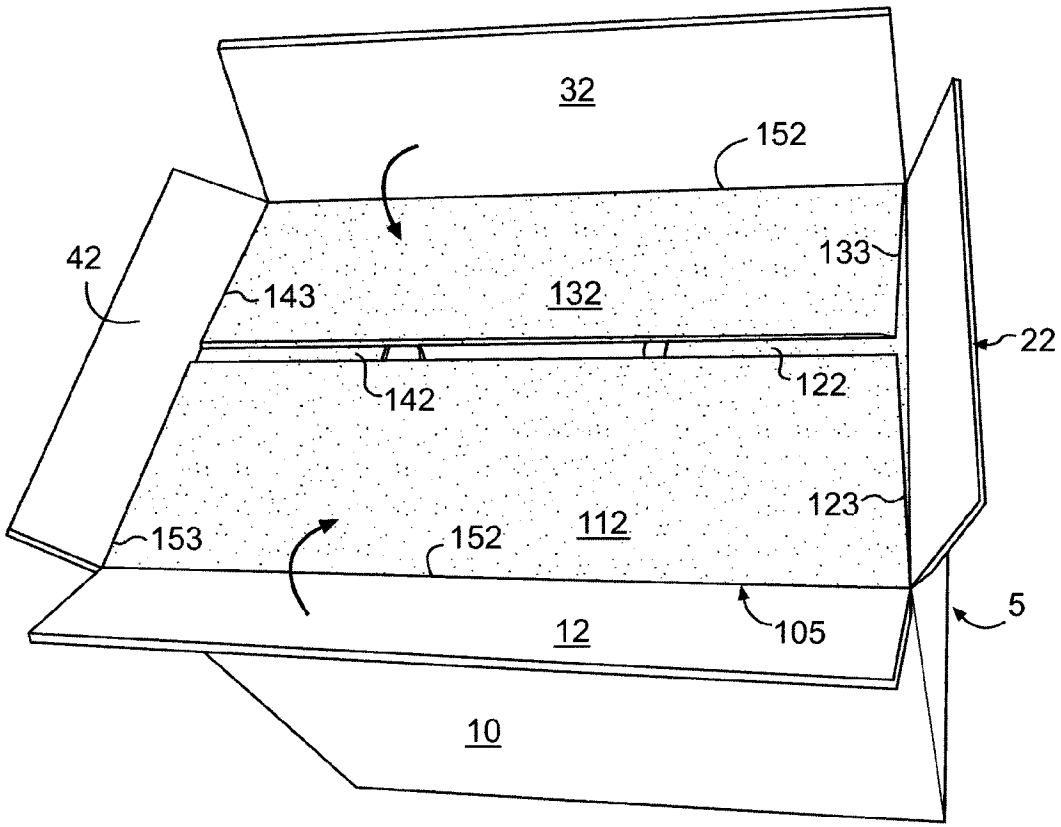
FIG. 6 illustrates an erection step of the first carton embodiment.

Referring to FIGS. 5 and 6, after loading the partially erected carton with articles, the open top end of the partially erected carton may be closed. The top is closed by folding the top flaps 122, 142 inwardly at the oblique creases 126, 128 (FIG. 1C) and 146, 148, respectively. The top flaps 112, 132 are then folded inwardly about the fold line 152 (FIG. 1C) in the direction of the curved arrows as shown in FIG. 6. If desired, the top flaps 112, 132, 122, 142 may be adhered together.

The top end flaps 22, 42 of the major blank 5 are then folded over and the undersides of the top side flaps 12, 32 are adhered to the exterior sides of the top end flaps 22, 42 to complete erection of the carton. FIG. 7 illustrates the erected carton 280 with the articles accommodated therein. The carton 280 has a substantially parallelepipedal shape. In the exemplary embodiment shown in FIG. 7, the overlapped handle features 25, 125 and 45, 145 of the major blank 5 and the upper minor blank 105, respectively, form two-ply handles 247, 249, one at each end of the carton 280. The overlapping top flaps 112, 122, 132, 142, 12, 22, 32, 42 form a multi-ply top panel or closure 260, and the bottom flaps 214, 224, 234, 244, 14, 24, 34, 44 form a multi-ply bottom panel or closure 270. The tear strip 60 extends around the entire periphery of the carton 280.

FIG. 8 illustrates the carton 280 after opening and placed in an expanded configuration. The carton 280 may be opened, for example, by tearing the tear strip 60 around the periphery of the carton 280. When the tear strip 60 is removed, the top portion of the exterior ply (comprising portions of the major blank 5) of the carton 280, including the upper portions of the panels 10, 20, 30, 40 located above the tear strip 60 and the top flaps 12, 22, 32, 42, can be lifted off of the top of the remaining bottom portion of the carton 280. The detached upper portion of the major blank 5 can be lifted off of the remainder of the carton 280 because the major blank 5 is not adhered to the upper minor blank 105 above the tear strip 60. As shown in FIG. 8, an upper portion 282 of the upper minor blank 105, comprising the top flaps 112, 122, 132, 142, can be placed in an expanded configuration by unfolding and pulling the flaps upwardly. Opening the flaps 112, 122, 132, 142 so that they extend upright creates an expanded interior volume 290 of the carton 280. The liquid-tight vessel 90 lines the interior volume 290 and renders it liquid-tight.

Figure 9:
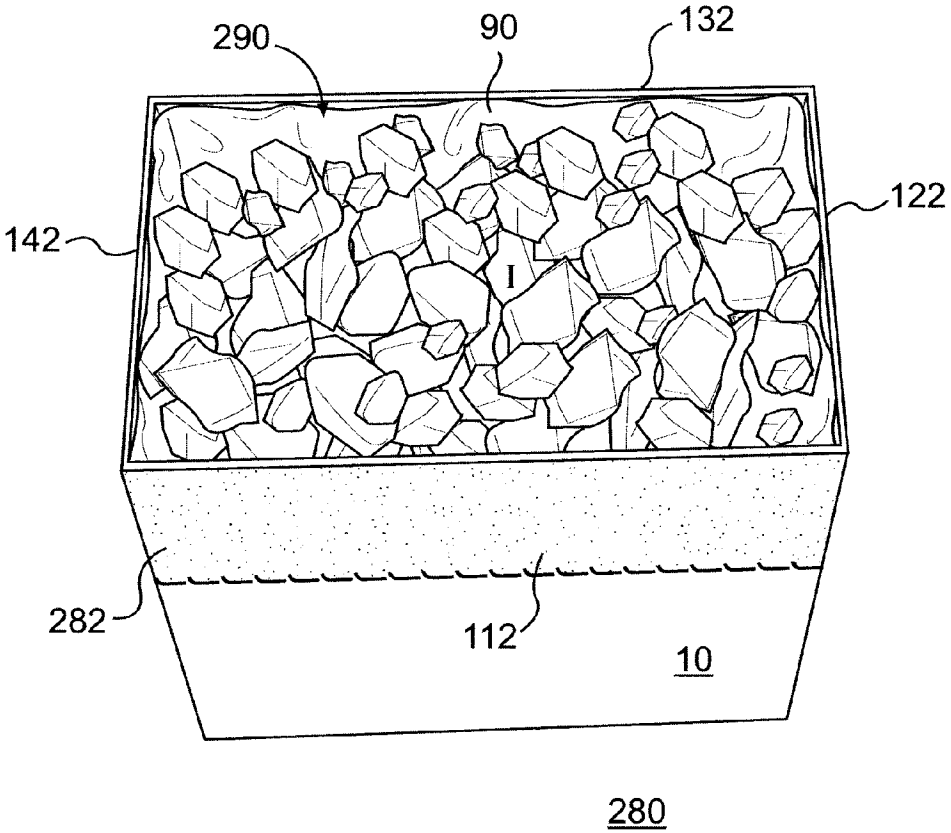
FIG. 9 illustrates the first carton embodiment opened and with ice poured over the carton contents.

Still referring to FIG. 8, a first height $H_1$ of the carton 280 generally conforms to the height of the side panels 10, 30, which is approximately the height of the carton 280 when closed (FIG. 7). A second, expanded height $H_2$ indicates the height of the interior volume 290 of the carton 280 in its expanded configuration. Referring to FIG. 9, ice I, for example, can be poured over the containers C within the carton 280 when the carton is in its expanded configuration. The upper portion 282 of the upper minor blank 105 provides the additional capacity in the carton to receive the ice I. Because the liquid-tight vessel 90 can be adhered adjacent to the upper edge of the blank 105, the expanded volume 290 can be water-tight nearly to a top edge of the expanded carton 280. According to one embodiment of the present invention, the height of the interior volume 290 of the carton 280 increases by at least 10% when expanded from the closed configuration illustrated in FIG. 7, having height $H_1$, to the open and expanded configuration shown in FIGS. 8 and 9, having height $H_2$. According to another embodiment of the invention, the height $H_2$ is at least 20% greater than the first height $H_1$.

The carton 280 can be carried using the reinforced, two-ply handles 247, 249 in the expanded configuration shown in FIGS. 8 and 9, as well as in the closed configuration shown in FIG. 7. If ice I is added to the interior volume 290, the added weight may constitute a significant weight to be borne by the carton 280. The two-ply sections of the carton 280 comprising the sections where the minor blanks 105, 205 overlap the major blank 5 add significant strength to the carton to enable relatively heavy loads to be carried in the carton 280. The reinforcement provided by the upper and lower minor blanks 105, 205 may be specifically targeted for regions of the carton 280 that require reinforcement, so that little board is wasted in forming the carton.

Figure 10:
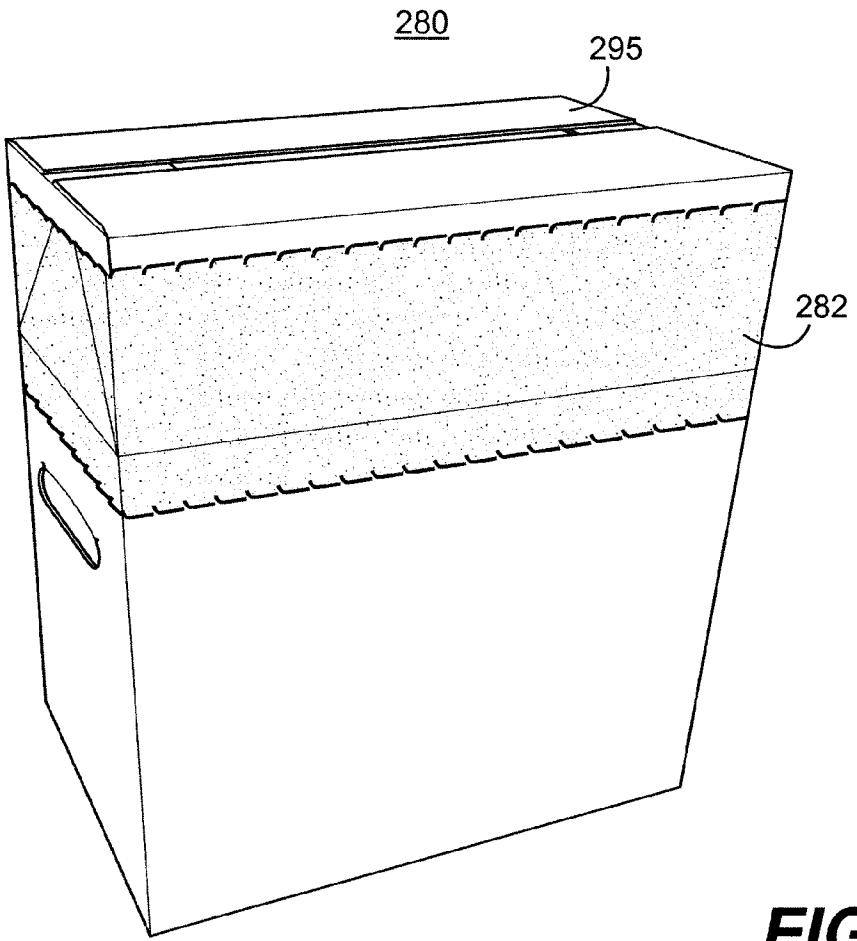
FIG. 10 illustrates the first carton embodiment after closing the top of the carton with a detached lid section.

FIG. 10 illustrates the carton 280 with the top of the carton closed by a lid portion 295 of the major blank 5 that was removed from the carton 280 during opening of the carton. As shown in FIG. 10, the lid 295 can be used to close the top of the carton 280 when it its expanded configuration. In the illustrated embodiment, the carton 280 is loaded with fifteen twelve-ounce bottle beverage containers C disposed in a 3×5×1 configuration. Other arrangements are also possible.

Figure 11A:
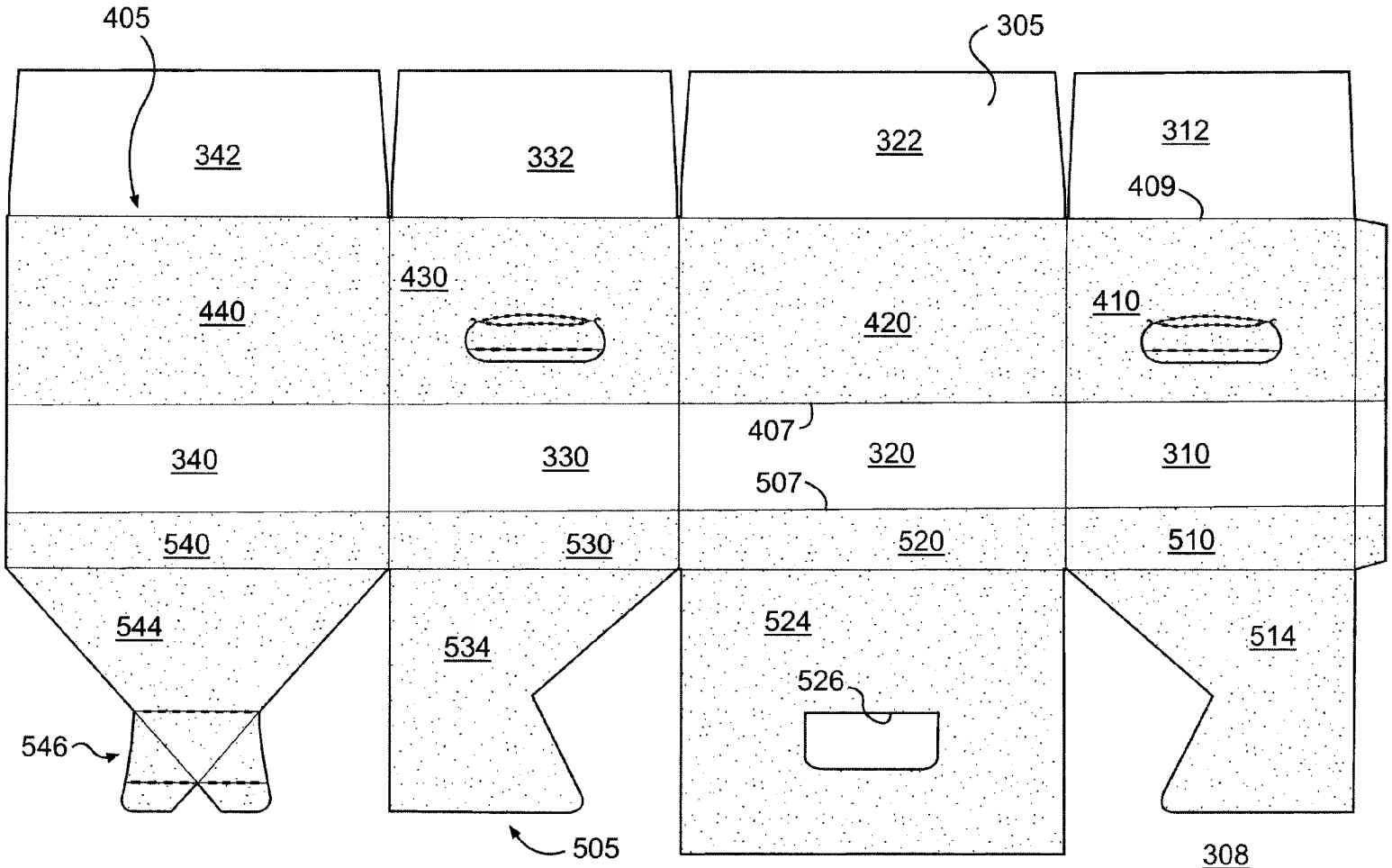
FIG. 11A is a plan view of a multi-ply blank used to form a carton according to a second embodiment of the invention.

FIG. 11A is a plan view of a multi-ply blank 308 used to form a carton 580 (illustrated in FIG. 14) according to the second embodiment of the invention. The blank 308 is formed from a major blank 305 and upper and lower minor blanks 405, 505, respectively, adhered, laminated or otherwise joined to the interior side of the major blank 305. In the drawing figures of this specification, the surface of the minor blanks 405, 505 are shaded with stippling solely to distinguish the minor blanks 405, 505 from the major blank 305, which is not stippled. The interior or underside surface of the major blank 305, with the minor blanks 405, 505 adhered thereto, is visible in FIG. 11A. In the illustrated embodiment, the minor blanks 405, 505 are adhered to the interior side of the major blank 5, although they may be adhered to the exterior or print side. Overlapping or coincident features in the blanks 305, 405, 505 are indicated by similar reference numbers, with reference numbers in the major blank 305 preceded by a "3," reference numbers in the upper minor blank 405 preceded by a "4," and reference numbers in the lower minor blank 505 preceded by a "5." FIG. 11B is a plan view of the exterior or print side of the major blank 305, FIG. 11C is a plan view of the upper minor blank 405 and FIG. 11D is a plan view of the lower minor blank 505.

Figure 11B:
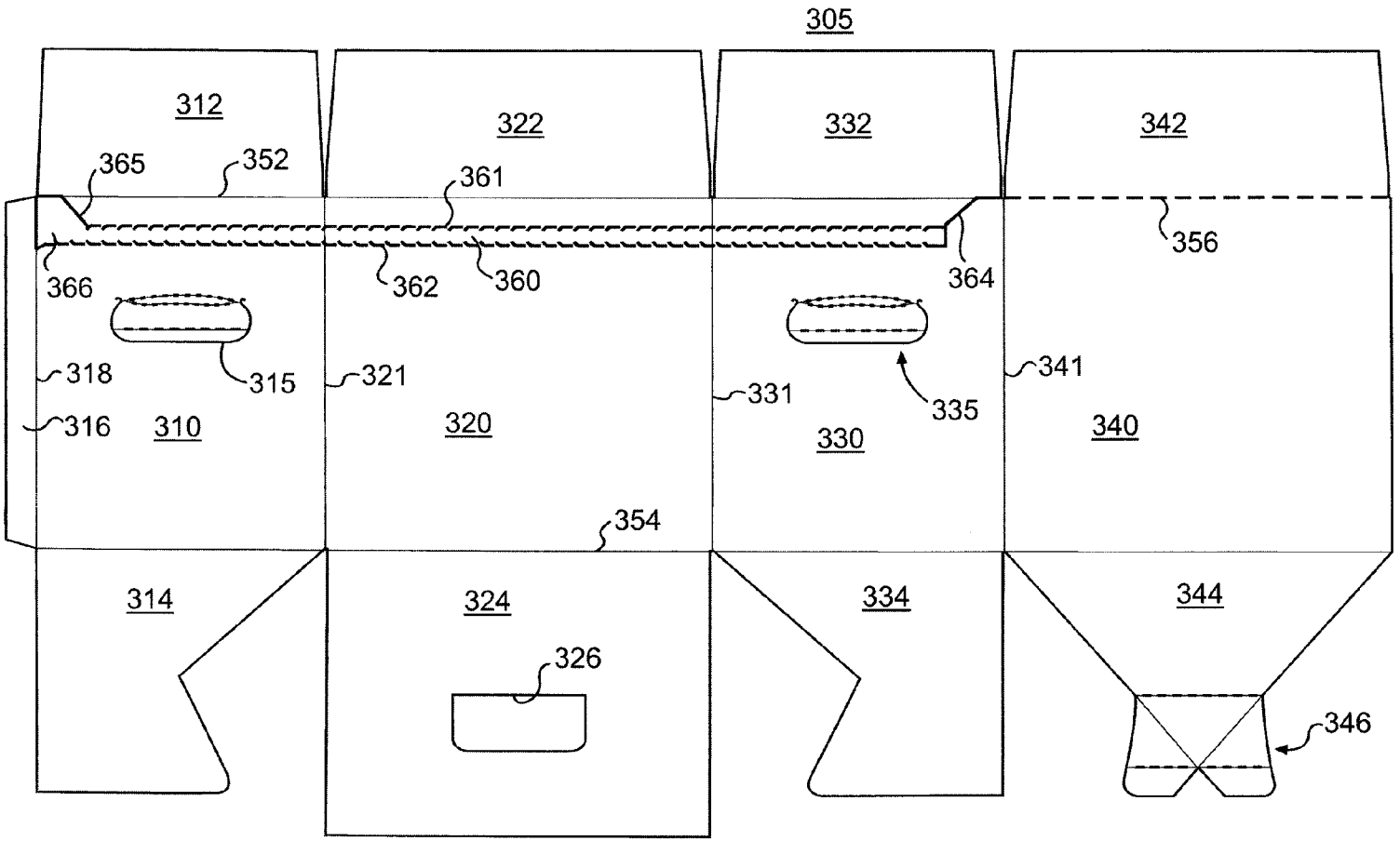
FIG. 11B is a plan view of a major blank of the multi-ply blank illustrated in FIG. 11A.
Figure 11C:
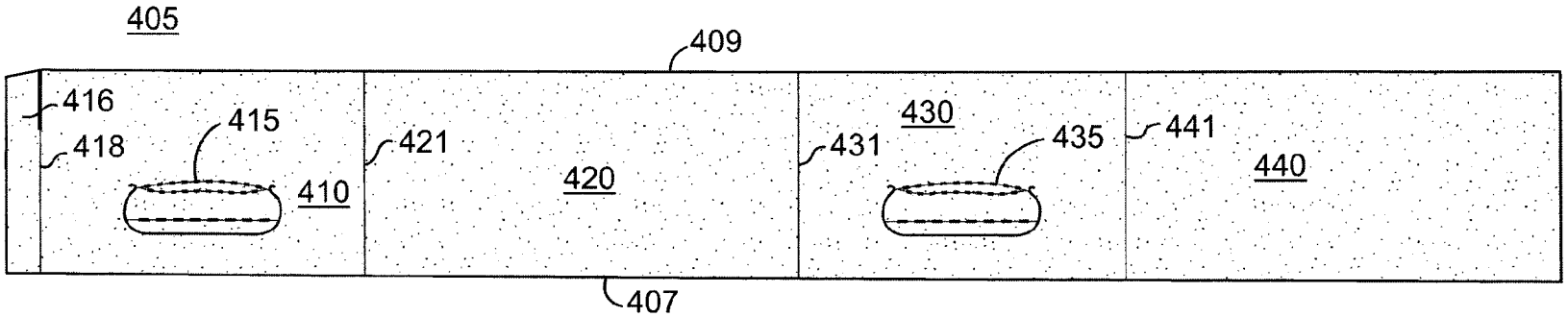
FIG. 11C is a plan view of a first minor blank of the multi-ply blank illustrated in FIG. 11A.
Figure 11D:
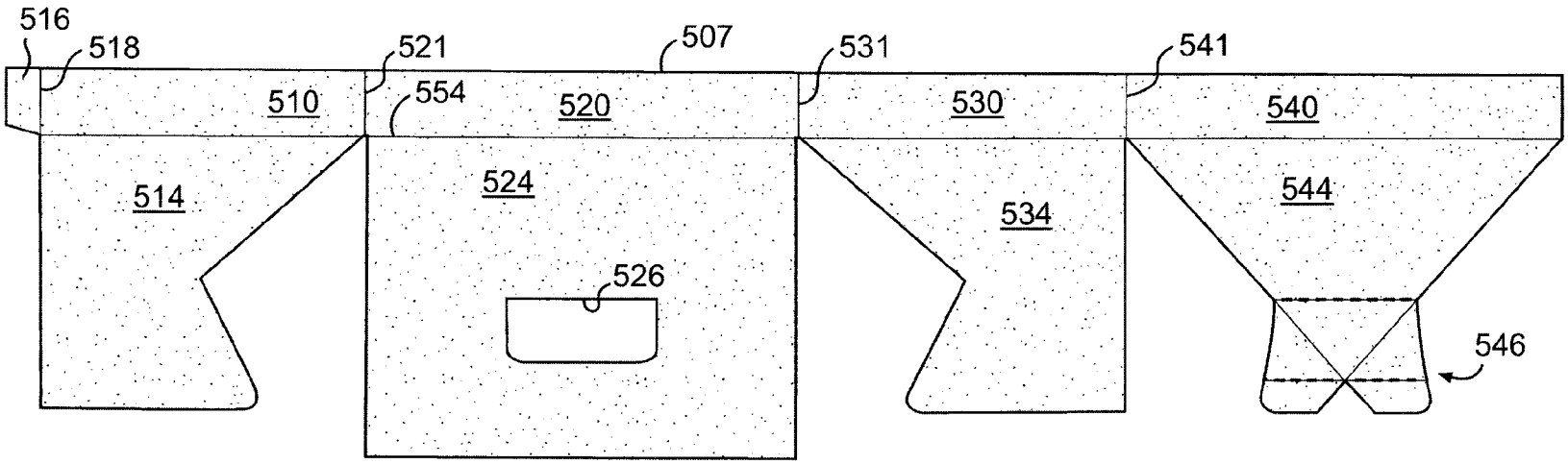
FIG. 11D is a plan view of a second minor blank of the multi-ply blank illustrated in FIG. 11A.

Referring to FIG. 11B, the major blank 305 comprises a first end panel 310, a first side panel 320 foldably connected to the first end panel 310 at a transverse fold line 321, a second end panel 330 foldably connected to the first end panel 320 at a transverse fold line 331, and a second side panel 340 foldably connected to the second end panel 330 at a transverse fold line 341. An adhesive flap 316 may be foldably connected to the first end panel 310 at a transverse fold line 318.

Still referring to FIG. 11B, a first end top flap 312 of the major blank 305 is foldably connected to the first end panel 310 at a longitudinal fold line 352 and a first end bottom flap 314 is foldably connected to the first end panel 310 at a longitudinal fold line 354. A first side top flap 322 is foldably connected to the first side panel 320 at the longitudinal fold line 352 and a first side bottom flap 324 is foldably connected to the first side panel 320 at the longitudinal fold line 354. A second end top flap 332 is foldably connected to the second end panel 330 at the longitudinal fold line 352 and a second end bottom flap 334 is foldably connected to the second end panel 330 at the longitudinal fold line 354. A second side top flap 342 is foldably connected to the second side panel 340 at a longitudinal cut-space hinge line 356 and a second side bottom flap 344 is foldably connected to the second side panel 340 at the longitudinal fold line 354. The top flaps 312, 322, 332, 342 extend along a first or upper marginal area of the blank major 305. The bottom flaps 314, 324, 334, 344 extend along a second or lower marginal area of the major blank 305. A handle feature 315 is formed in the first end panel 310 and a similar handle feature 335 is formed in the second end panel 330.

Figure 14:
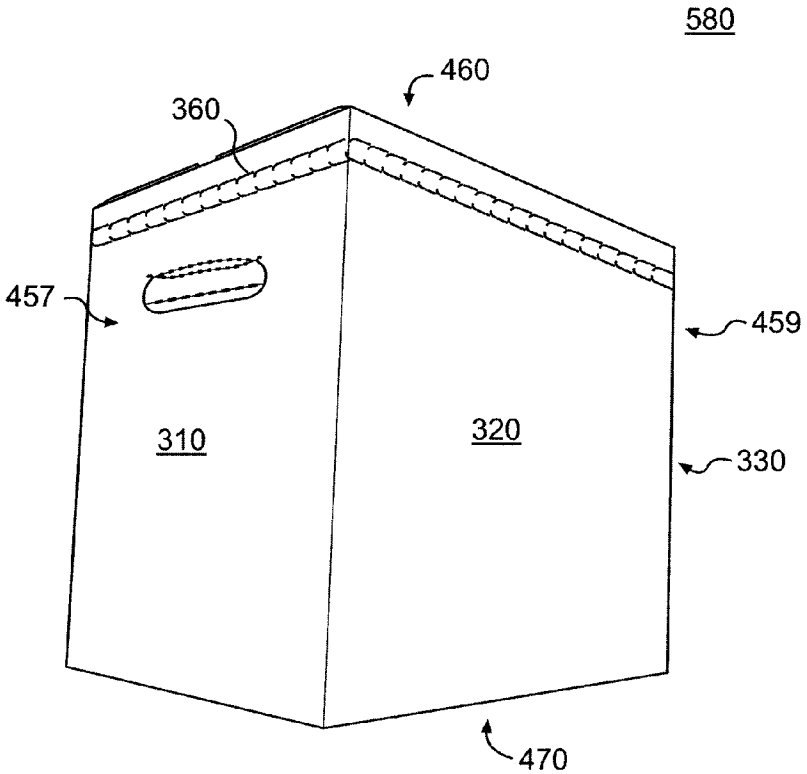
FIG. 14 illustrates the erected second carton embodiment with containers accommodated therein.

The bottom flaps 314, 324, 334, 344 are arranged to form an interlocking bottom panel or closure in the erected carton 580 (FIG. 14). The bottom flap 324 includes a locking aperture 326, and the bottom flap 344 includes a locking projection 346 dimensioned to be received within the locking aperture 326. The locking projection 346 and the locking aperture 326 can be larger than typical locking features in order to provide added load-bearing capacity for the carton 580. The creasing of the locking projection 346 facilitates insertion of the locking projection 346 into the locking aperture 326.

According to one aspect of the invention, a longitudinal tear strip 360 extends through the panels 310, 320, 330. The tear strip 360 is defined at its upper and lower edges by spaced longitudinal tear lines 361, 362. The tear line 361 extends to an oblique cut 364 in the second end panel 330, and to an oblique cut 365 in the first end panel 310. A pull tab 366 may be included at one end of the tear strip 360 to facilitate access to the tear strip. The tear strip 360 allows a top of the carton 580 (FIG. 14) to be opened, as discussed in further detail below.

FIG. 11C illustrates the side of the upper minor blank 405 that is adhered to the major blank 305 illustrated in FIG. 11B. The opposite side of the upper minor blank 405 faces the interior of the carton 580 (illustrated in FIG. 14) formed from the multi-ply blank 308. The upper minor blank 405 comprises a first end panel 410, a first side panel 420 foldably connected to the first end panel 410 at a transverse fold line 421, a second end panel 430 foldably connected to the first side panel 420 at a transverse fold line 431, and a second side panel 440 foldably connected to the second end panel 430 at a transverse fold line 441. A handle feature 415 is formed in the first end panel 410 and a similar handle feature 435 is formed in the second end panel 430. An adhesive flap 416 may be foldably connected to the first end panel 410 at a transverse fold line 418.

Referring to FIG. 11D, the lower minor blank 505 comprises a first end panel 510, a first side panel 520 foldably connected to the first end panel 510 at a transverse fold line 521, a second end panel 530 foldably connected to the first side panel 520 at a transverse fold line 531, and a second side panel 540 foldably connected to the second end panel 530 at a transverse fold line 541. An adhesive flap 516 may be foldably connected to the first end panel 510 at a transverse fold line 518. A first end bottom flap 514 is foldably connected to the first end panel 510 at a longitudinal fold line 554. A first side bottom flap 524, which includes a locking aperture 526, is foldably connected to the first side panel 520 at the longitudinal fold line 554. A second end bottom flap 534 is foldably connected to the second end panel 530 at the longitudinal fold line 554. A second side bottom flap 544, which includes a locking projection 546, is foldably connected to the second side panel 540 at the longitudinal fold line 554. The bottom flaps 514, 524, 534, 544 extend along a lower marginal area of the lower minor blank 505. The bottom flaps 514, 524, 534, 544 of the blank 505 overlap corresponding bottom flaps 314, 324, 334, 344, respectively, in the major blank 305.

Referring to FIGS. 11A-11D, the multi-ply blank 308 may be constructed by adhering the upper minor blank 405 and the lower minor blank 505 to the interior side of the major blank 305. Each of the panels 410, 420, 430, 440 of the upper minor blank 405 may be adhered to corresponding panels 310, 320, 330, 340, respectively, of the major blank 305, below the longitudinal fold line 352 in the major blank 305. The lower minor blank 505 can be adhered to the major blank 305 so that each panel or flap 510, 520, 530, 540, 514, 524, 534, 544 of the minor blank 505 is adhered to a corresponding panel or flap 310, 320, 330, 340, 314, 324, 334, 344, respectively, of the major blank 305. Glue strips, applied hot melt glue, lamination processes or other adhesives and means can be used to adhere the major and minor blanks 305, 405, 505 together.

Figure 11E:
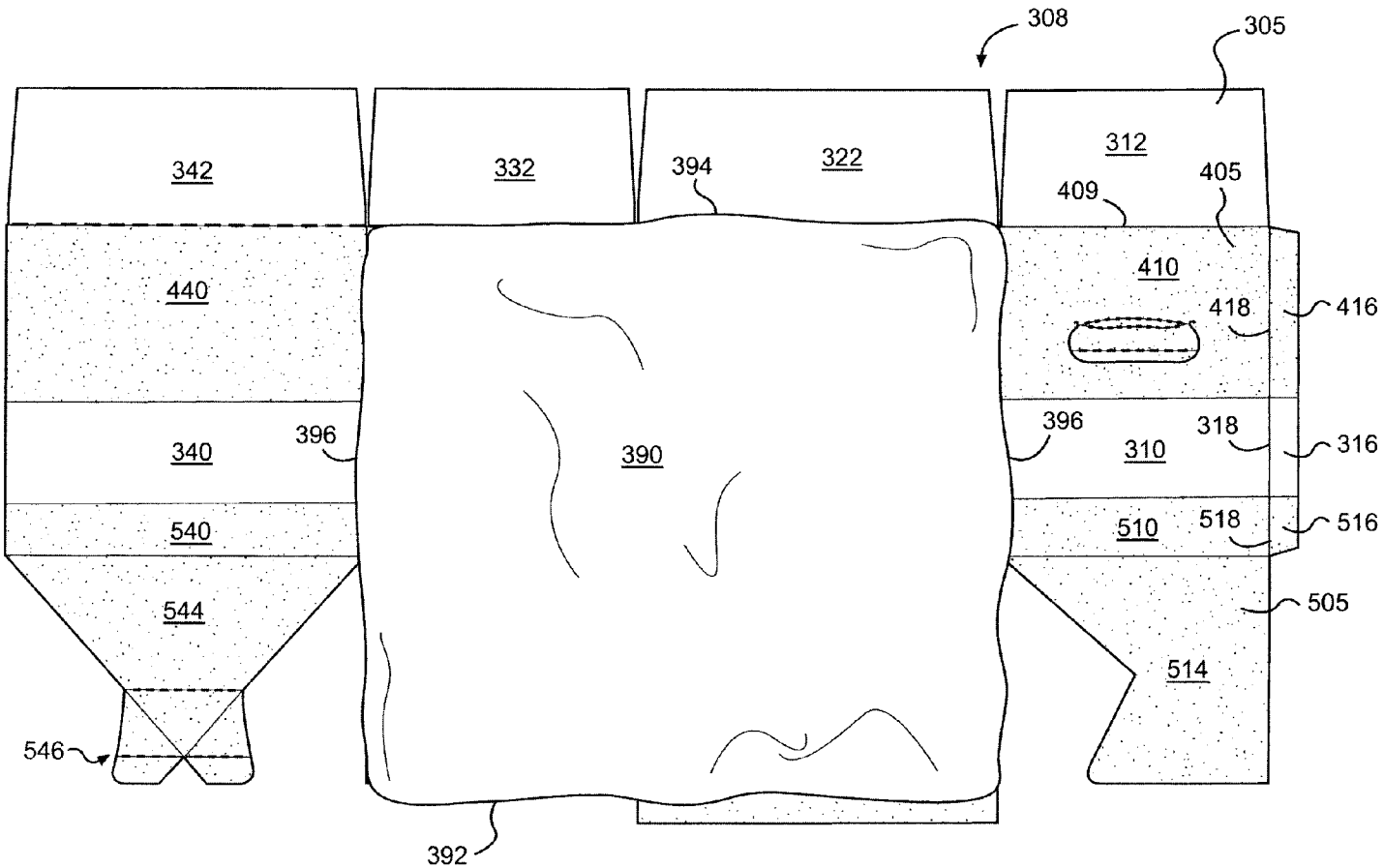
FIG. 11E illustrates application of a liquid-tight vessel to the multi-ply blank of FIG. 11A.

Referring to FIG. 11E, a liquid-tight receptacle or vessel 390 is placed on the interior side of the multi-ply blank 308. The liquid-tight vessel has sealed portions 392, 396 and an open top portion 394 through which articles can be placed in the vessel. The liquid-tight vessel 390 can be adhered to one or more locations of the panels 310, 410, 510, 320, 420, 520, 330, 430, 530, 340, 440, 540. In one embodiment, it is sufficient to adhere the liquid-tight vessel 390 to the upper minor blank 405, such as at an upper edge of the minor blank 405. The liquid-tight vessel 390 may be joined to the multi-ply blank 308 so that when the blank 308 is opened to a generally tubular form, the upper open end of the liquid-tight vessel 390 is supported in an open position by its adherence to the interior surface of the blank 308. The liquid-tight vessel 390 can be formed from, for example, any liquid-tight material.

An exemplary method of erection of the multi-ply blank 308 into the carton 580 and loading of the carton will now be discussed with reference to FIGS. 11A-14.

Figure 12:
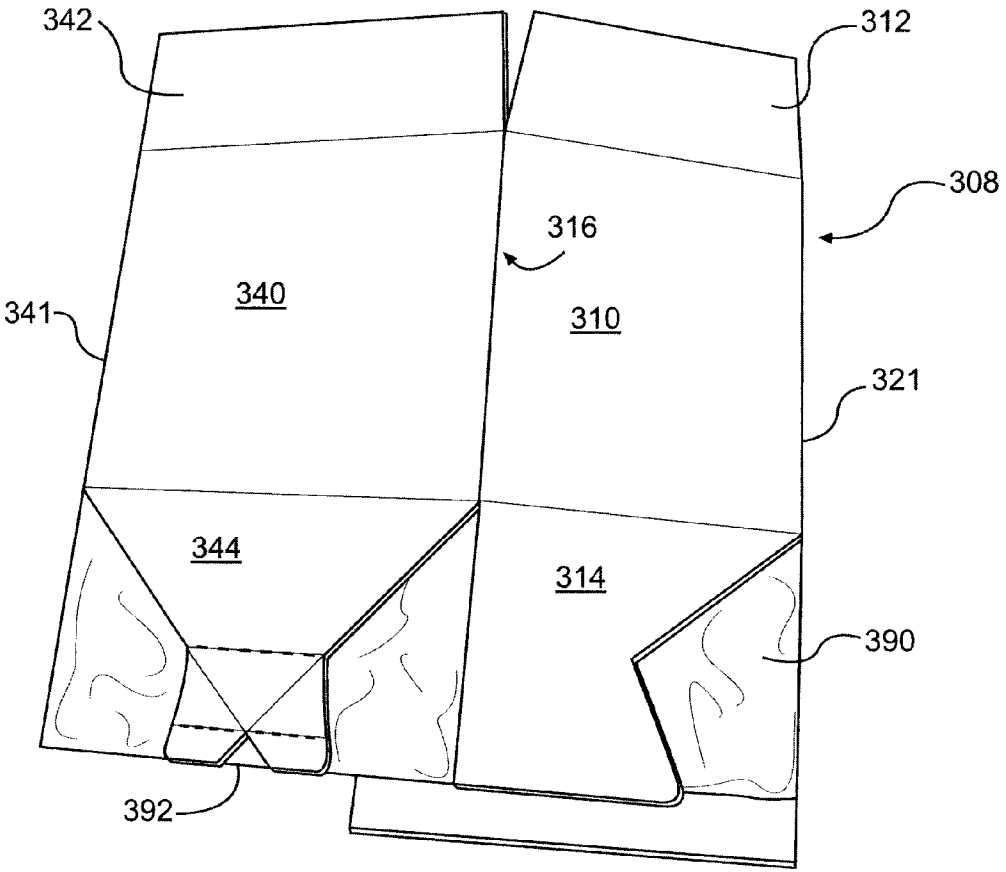
FIG. 12 illustrates an erection step in which the blank of FIG. 1A is formed into the carton according to the second embodiment.

Referring to FIGS. 11A-11E and specifically to FIG. 12, the multi-ply blank 308 is folded about the transverse fold lines 321, 341 in the major blank 305 and about the corresponding transverse fold lines 421, 441, 521, 541 in the minor blanks 405, 505 so that the exterior side of the adhesive flap 316 of the major blank 305 is adhered to the interior sides of the second end panels 340, 440, 540 in the blanks 305, 405, 505, respectively. Folding of the blank 308 as shown in FIG. 12 can also serve to press the interior surfaces of the blank 308 against the vessel 390 so that the vessel is adhered thereto. The bag/blank combination article illustrated in FIG. 12 has a generally flat closed tubular form that may be shipped to a location for distribution to a consumer, packaging facility, retailer, etc.

Figure 13:
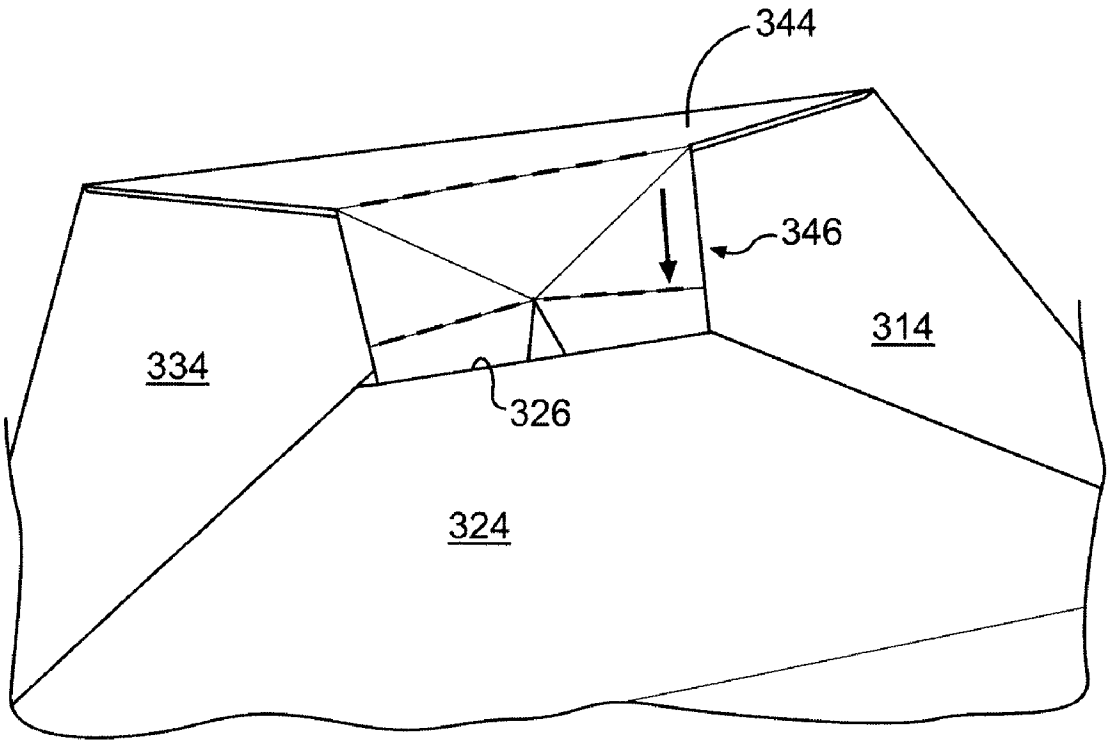
FIG. 13 illustrates an erection step of the second carton embodiment.

FIG. 13 illustrates closure of the bottom end of the partially erected blank 308. In FIG. 13, the folded and glued blank 308 has been opened into a generally tubular form. Opening the blank 308 as shown in FIG. 13 also expands or opens up the liquid-tight vessel 390. The bottom of the partially erected carton may be closed by first folding the overlapping flaps 324, 524 over the open carton bottom. The overlapping flaps

324, 524 and 344, 544 are then folded over the bottom flaps 324, 524. The adhered overlapping locking projections 346, 546 of the blanks 305, 505, respectively, are then pressed in the direction of the arrow into the overlapping locking apertures 326, 526 in the bottom flaps 324, 524, respectively.

After closing the bottom of the partially erected carton, articles such as containers can be loaded into the partially erected carton. If desired, the liquid-tight vessel 390 may be pressed against the interior sides of the carton in order to further secure the vessel 390 to adhesive located on the interior of the partially erected carton. In the illustrated embodiment, the liquid-tight vessel 390 is adhered at least to the upper minor blank 405 adjacent to the upper edge of the upper minor blank 405. After loading the partially erected carton with articles, the open top end of the partially erected carton may be closed. The top may be closed by folding the end top flaps 312, 332 inwardly about the fold line 352. The side top flaps 322, 342 are then folded inwardly about the lines 352, 356, respectively, and adhered to the top flaps 322, 342.

FIG. 14 illustrates the erected carton 580 with the articles accommodated therein. The carton 580 has a substantially parallelepipedal shape. In the exemplary embodiment shown in FIG. 14, the overlapped handle features 315, 415 and 335, 435 of the major blank 305 and the upper minor blank 405, respectively, form two-ply handles 457, 459, respectively, one at each end of the carton 580. The top flaps 312, 322, 332, 342 form a multi-ply top panel or closure 460. The interlocked, overlapping flaps 314, 514, 324, 524, 334, 534, 344, 544 form a multi-ply bottom panel or closure 470. The tear strip 360 extends around the entire periphery of the carton 580.

Figure 15:
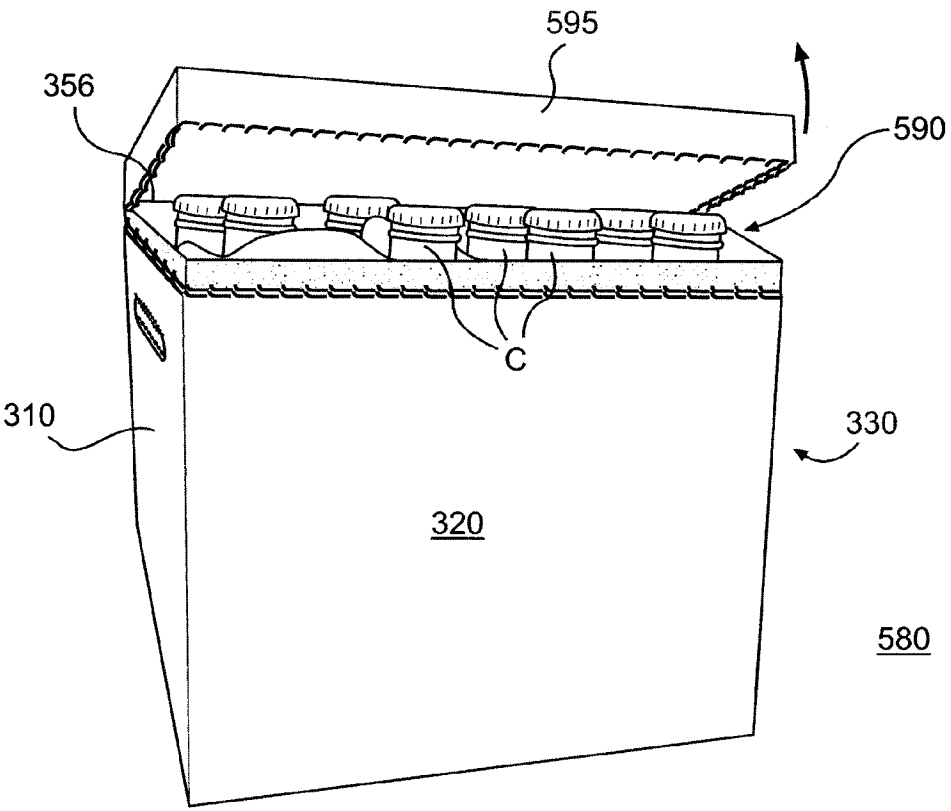
FIG. 15 illustrates the second carton embodiment with the top of the carton being opened.

FIG. 15 illustrates the carton 580 after opening. The carton 580 is opened by pulling the tear strip 360 around a portion of the perimeter of the carton 580. The containers C accommodated within an interior volume 590 of the carton 580 can now be removed from the carton. After removing the tear strip 360, the top portion of the carton 580 defines a pivotable lid 595 that is pivotable about the hinge line 356 (FIG. 11B) in the direction of the curved arrow. With the lid 595 pivoted open, ice (not illustrated), for example, can be poured over the containers C accommodated within the interior volume 590 to cool the containers C. The liquid-tight vessel 390 within the carton 580 lines the interior volume 590 and serves to retain runoff from the ice as it melts. The lid 595 can be, for example, selectively opened and closed to close off the interior volume 590 of the carton 580. Alternatively, the lid 595 can be removed from the carton 580 by further tearing along the cut-space hinge line 356. In the illustrated embodiment, the carton 580 is loaded with twelve twelve-ounce bottle beverage containers C disposed in a 3×4×1 configuration. Other arrangements are also possible.

The carton 580 can be carried using the reinforced, two-ply handles 457, 459 (FIG. 14) while in the opened configuration shown in FIG. 15, as well as in the closed configuration shown in FIG. 14. If ice is added to the interior volume 590, the added weight may constitute a significant weight to be borne by the carton 580. The two-ply sections of the carton 580 comprising the sections where the minor blanks 405, 505 overlap the major blank 305 adds significant strength to the carton to enable relatively heavy loads to be carried in the carton 580. The reinforcement provided by the upper and lower minor blanks 405, 505 may be specifically targeted for regions of the carton 580 that require reinforcement, so that little board is wasted in forming the carton.

Figure 16A:
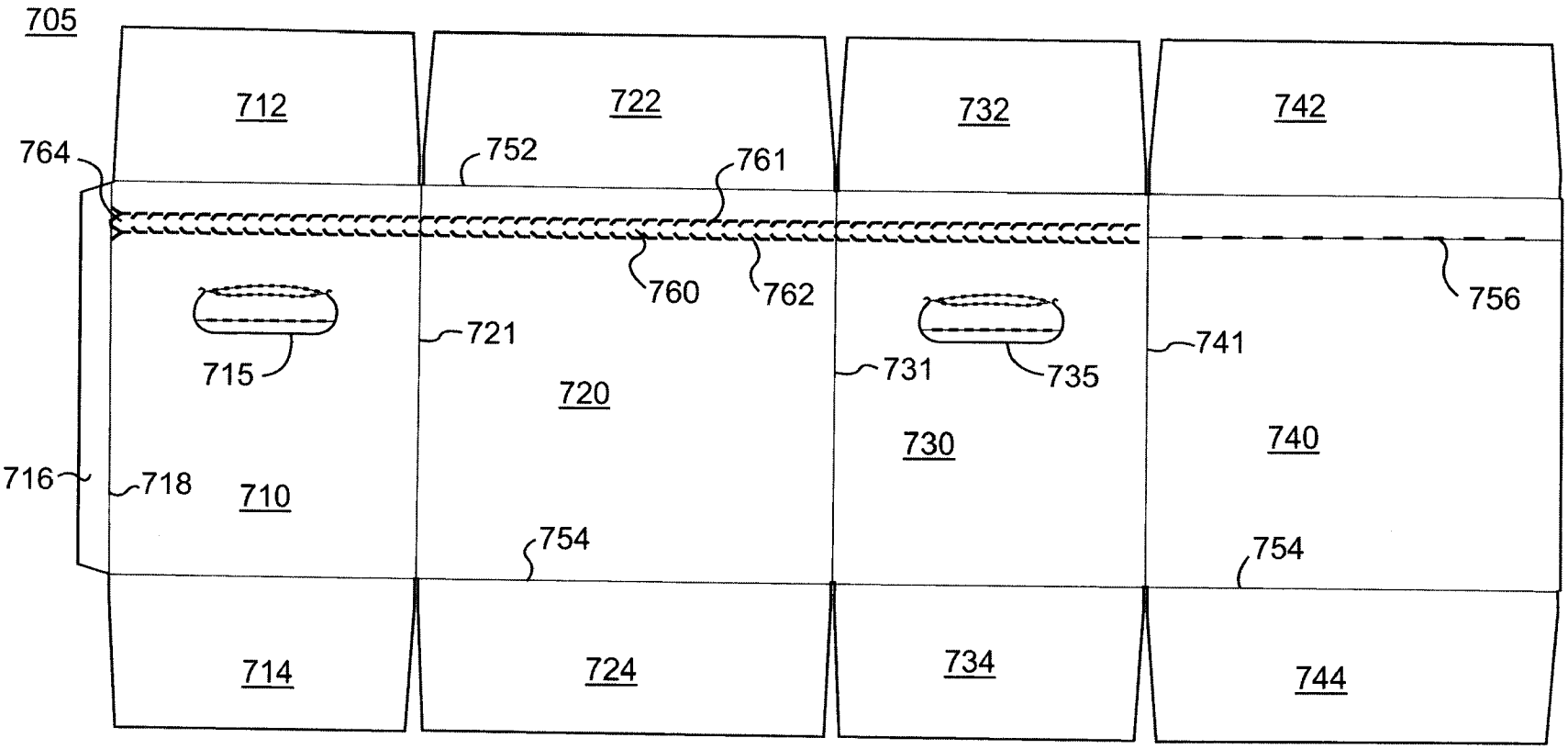
FIG. 16A is a plan view of a major blank of a multi-ply blank according to a third embodiment of the invention.
Figure 16B:
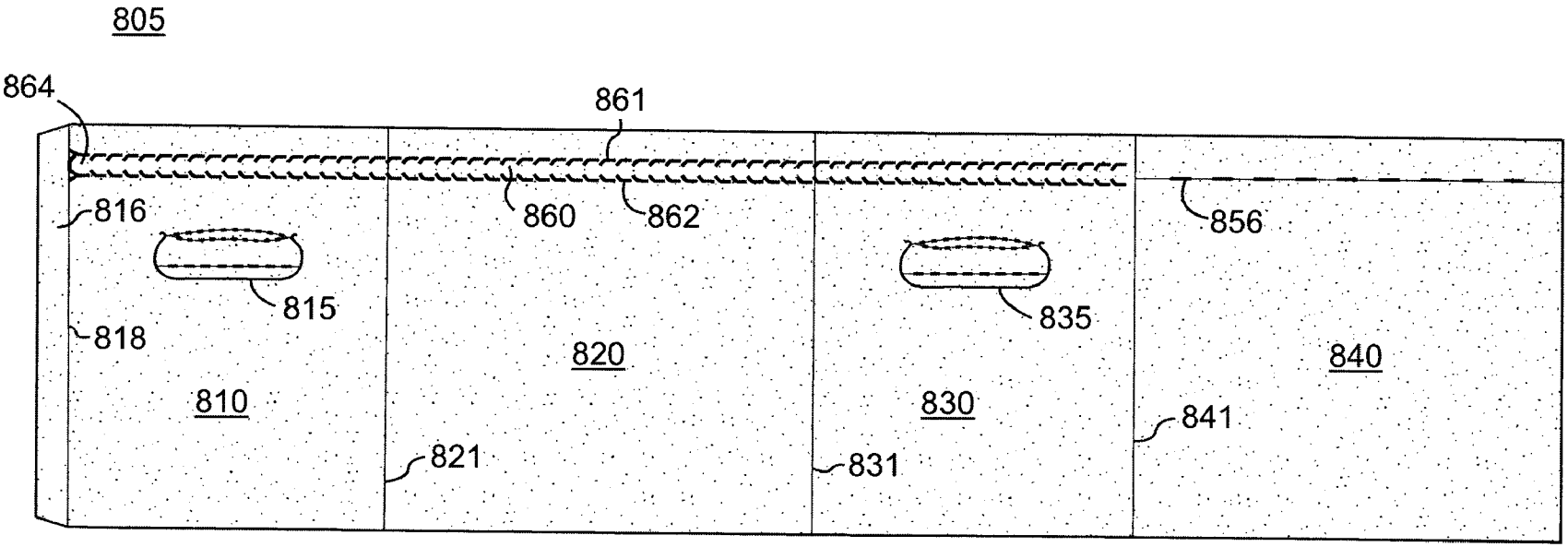
FIG. 16B is a plan view of a minor blank of the multi-ply blank according to the third embodiment of the invention.

FIG. 16A is a plan view of a major blank 705, and FIG. 16B is a plan view of a minor blank 805 according to a third embodiment of the invention. The minor blank 805 is adhered, laminated or otherwise joined to the interior side of the major blank 705 to form the multi-ply blank 708 illustrated in FIG. 16C. The multi-ply blank 708 is used to form a carton 880 (FIG. 17) according to the third embodiment of the invention. The exterior or print surface of the major blank 705 is visible in FIG. 16A. Overlapping or coincident features in the blanks 705, 805 are indicated by similar reference numbers, with reference numbers in the major blank 705 preceded by a "7," and reference numbers in the minor blank 805 preceded by an "8." In the drawing figures of this specification, the surface of the minor blank 805 is shaded with stippling solely to distinguish the minor blank 805 from the major blank 705, which is not stippled.

Referring to FIG. 16A, the major blank 705 comprises a first end panel 710, a first side panel 720 foldably connected to the first end panel 710 at a transverse fold line 721, a second end panel 730 foldably connected to the first end panel 720 at a transverse fold line 731, and a second side panel 740 foldably connected to the second end panel 730 at a transverse fold line 741. An adhesive panel 716 may be foldably connected to the first end panel 710 at a transverse fold line 718. A first end top flap 712 is foldably connected to the first end panel 710 at a longitudinal fold line 752 and a first end bottom flap 714 is foldably connected to the first end panel 710 at a longitudinal fold line 754. A first side top flap 722 is foldably connected to the first side panel 720 at the longitudinal fold line 752 and a first side bottom flap 724 is foldably connected to the first side panel 720 at the longitudinal fold line 754. A second end top flap 732 is foldably connected to the second end panel 730 at the longitudinal fold line 752 and a second end bottom flap 734 is foldably connected to the second end panel 730 at the longitudinal fold line 754. A second side top flap 742 is foldably connected to the second side panel 740 at the longitudinal fold line 752 and a second side bottom flap 744 is foldably connected to the second side panel 740 at the longitudinal fold line 754. The top flaps 712, 722, 732, 742 extend along a first or upper marginal area of the major blank 705. The bottom flaps 714, 724, 734, 744 extend along a second or lower marginal area of the major blank 705. A handle feature 715 is formed in the first end panel 710 and a similar handle feature 735 is formed in the second end panel 730.

According to one aspect of the invention, a longitudinal tear strip 760 extends through the panels 710, 720, 730. The tear strip 760 is defined at its upper and lower edges by a pair of spaced longitudinal tear lines 761, 762. A pull tab 764 may be included at one end of the tear strip 760 to facilitate access to the tear strip. A cut-crease hinge line 756 extends from the opposite end of the tear strip 760, through the second side panel 740. The tear strip 760 allows a top of the carton 880 (FIG. 17) to be opened, as discussed in further detail below.

FIG. 16B illustrates the minor blank 805. Referring also to FIG. 16A, the minor blank 805 is dimensioned to overlap a central portion of the major blank 705 between the fold lines 752, 754. Referring to FIG. 16B, the minor blank 805 comprises a first end panel 810, a first side panel 820 foldably connected to the first end panel 810 at a transverse fold line 821, a second end panel 830 foldably connected to the first side panel 820 at a transverse fold line 831, and a second side panel 840 foldably connected to the second end panel 830 at a transverse fold line 841. An adhesive panel 816 may be foldably connected to the first end panel 810 at a transverse fold line 818. A handle feature 815 is formed in the first end panel 810 and a similar handle feature 835 is formed in the second end panel 830.

Still referring to FIG. 16B, a longitudinal tear strip 860 extends through the panels 810, 820, 830. The tear strip 860 is defined at its upper and lower edges by a pair of spaced longitudinal tear lines 861, 862. A pull tab 864 may be included at one end of the tear strip 860 to facilitate access to the tear strip. A cut-crease hinge line 856 extends away from the opposite end of the tear strip 860, through the second side panel 840.

Figure 16C:
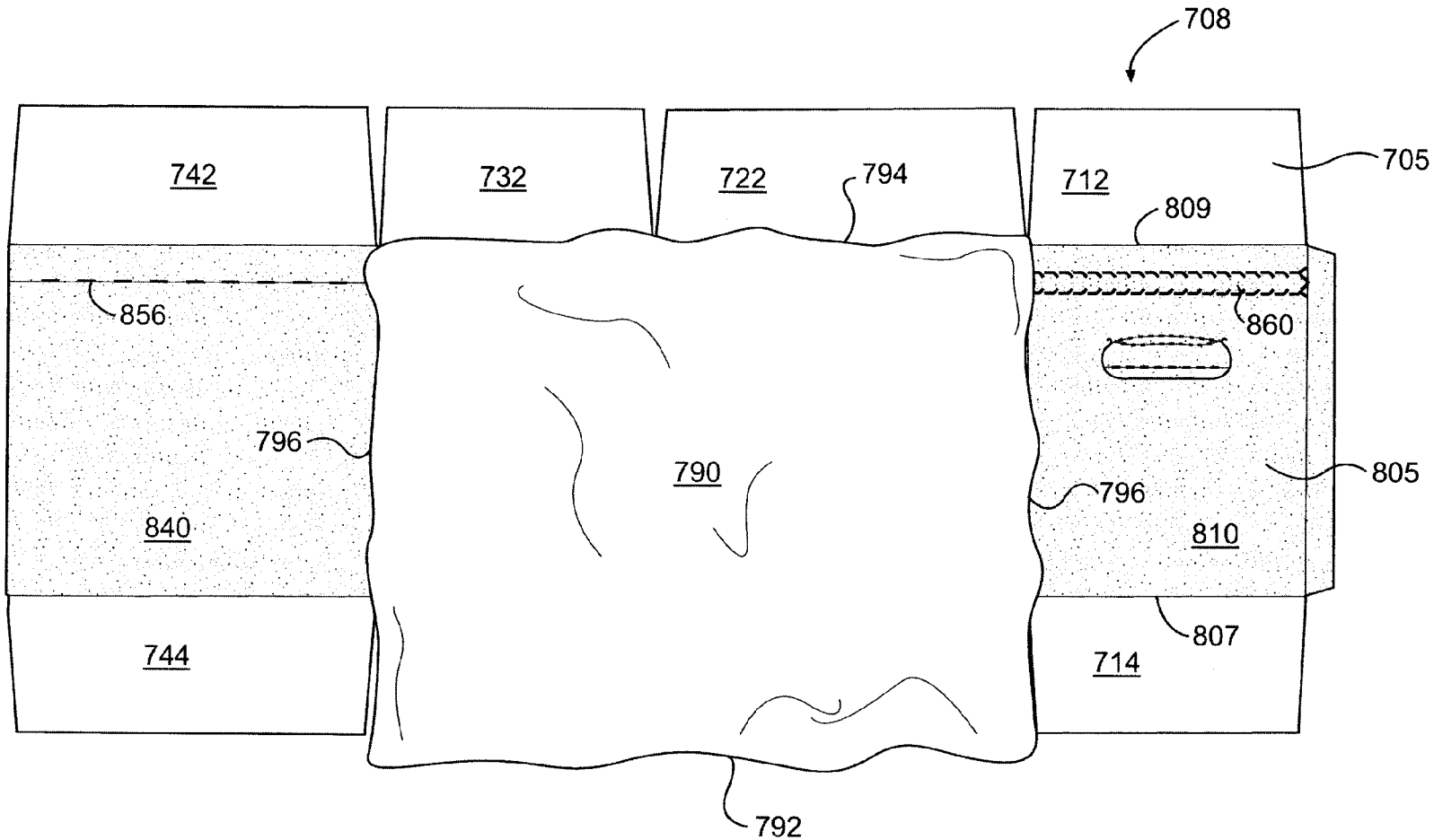
FIG. 16C illustrates the multi-ply blank according to the third embodiment of the invention with a liquid-tight vessel applied thereto.

Referring to FIGS. 16A-16C, in one exemplary embodiment, the multi-ply blank 708 may be constructed by adhering the minor blank 805 to the interior side of the major blank 705 below the tear strip 760 and below the hinge line 756, and above the fold line 754. In another embodiment, substantially all of each of the panels 810, 820, 830, 840 of the minor blank 805 are adhered to corresponding panels 710, 720, 730, 740, between the longitudinal fold lines 752, 754. In this embodiment, the tear strips 760, 860 are joined and operate as a single tear strip. In yet another embodiment, the panels 740, 840 are adhered between the fold lines 752, 754, and the panels 810, 820, 830 are joined to corresponding panels 710, 720, 730 below the tear strips 760, 860. In this embodiment, the carton 880 (FIG. 17) is opened by opening the major blank 705 at the tear line 760 and subsequently opening the minor blank 805 at the tear line 860. Glue strips, applied hot melt glue, lamination processes or other adhesives and means can be used to adhere the major and minor blanks 705, 805 together.

Referring specifically to FIG. 16C, a liquid-tight receptacle or vessel 790 is then placed on the interior side of the multi-ply blank 708. The liquid-tight vessel 790 has sealed portions 792, 796 and an open top portion 794 through which articles can be placed in the vessel. The vessel 790 can be adhered to, for example, one or more locations of the panels 810, 820, 830, 840. The blank 708 can be folded and glued into a closed, substantially flat tubular form as discussed above with reference to the first and second embodiments. The liquid-tight vessel 790 may be joined to the multi-ply blank 708 so that when the blank 708 is opened to a generally tubular form, the open top portion 794 of the liquid-tight vessel 790 is supported in an open position by its adherence to the interior surface of the blank 708.

Figure 17:
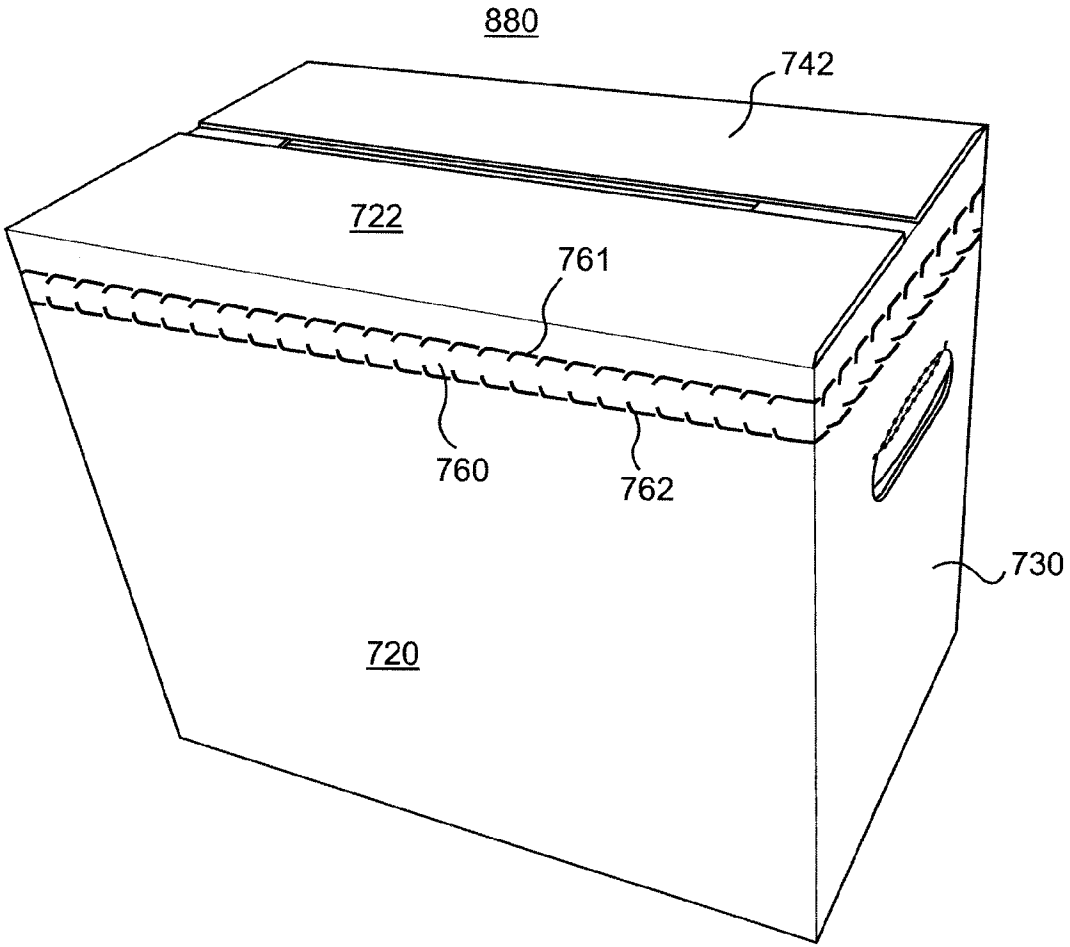
FIG. 17 illustrates a carton formed from the multi-ply blank of FIG. 16C according to the third embodiment.

The blank 708 can be opened up into a tubular form and the bottom closed by adhering the bottom flaps 714, 724, 734, 744 together. After closing the bottom of the partially erected carton, articles such as, for example, containers (not illustrated) can be loaded into the partially erected carton. The illustrated embodiment is dimensioned to accommodate twelve containers in a 3×4×1 configuration, although other arrangements are possible. Referring to FIG. 17, the top is closed by folding the end top flaps 712, 732 inwardly about the fold line 752. The side top flaps 722, 742 are then folded inwardly about the line 752, 756, respectively, and adhered to the flaps 722, 742. Closing the top completes erection of the carton 880. The carton 880 can be opened by removing the tear strips 760, 860, either simultaneously or individually, and pivoting the top of the carton open at the overlapping hinge lines 756, 856. The liquid-tight vessel 790 lines the interior volume of the carton 780.

In the above embodiments, the cartons are described as accommodating twelve or fifteen 12-ounce cans containers C in differing configurations. Other arrangements of containers, packages, articles, and other items, however, can be accommodated within a carton constructed according to the principles of the present invention. For example, a carton constructed according to the principles of the present invention would also work satisfactorily if the carton were sized and shaped to hold articles in other configurations, such as 4×3×1, 3×6×1, 2×4×1, 2×5×1, 2×6×1, 4×6×1, etc., and multi-tier variations of the aforementioned configurations. The dimensions of the blanks may also be altered, for example, to accommodate various container forms. For example, 16-ounce petaloid bottles may be accommodated within cartons constructed according to the principles of the present invention.

In the illustrated embodiments, the liquid-tight vessels have sealed lower and side portions before being secured to the blanks. In an alternative embodiment, the vessels may be formed from barrier films and sealed during erection of the carton, such as is disclosed in U.S. application Ser. No. 11/612,103, the entire contents of which are hereby incorporated by reference.

In the exemplary embodiments discussed above, the major and minor blanks may be formed from, for example, clay coated newsprint (CCN), solid unbleached sulfate board (SUS), paperboard, and other materials. In general, the blanks may be constructed from paperboard having a caliper of at least about 14, for example, so that it is heavier and more rigid than ordinary paper. The blanks can also be constructed of other materials, such as cardboard, or any other material having properties suitable for enabling the carton to function at least generally as described above. The blanks can be coated with, for example, a clay coating. The clay coating may then be printed over with product, advertising, and other information or images. The blanks may then be coated with a varnish to protect information printed on the blanks.

The blanks may also be coated with, for example, a moisture barrier layer, on either or both sides of the blanks. For example, interior surfaces of the blanks may be coated with a moisture barrier layer to protect the blanks from condensation that may form on adjacent surfaces of the liquid-tight vessels. The blanks can also be laminated to or coated with one or more sheet-like materials at selected panels or panel sections.

The above embodiments may be described as having one or more panels adhered together by glue. The term "glue" is intended to encompass all manner of adhesives commonly used to secure carton panels and/or flaps in place.

The term "line" as used herein includes not only straight lines, but also other types of lines such as, for example, curved, curvilinear or angularly displaced and/or interrupted lines.

In accordance with the exemplary embodiment of the present invention, a fold line can be any substantially linear, although not necessarily straight, form of disruption or weakening in the blanks that facilitates folding therealong. More specifically, but not for the purpose of narrowing the scope of the present invention, examples of fold lines include: score lines; crease lines; a cut or a series of cuts that extend partially into and/or completely through the material along a desired line of weakness; and various sequential and/or overlapping combinations of these exemplary features.

In the present specification, a "panel" or "flap" need not be flat or otherwise planar. A "panel" or "flap" can, for example, comprise a plurality of interconnected generally flat or planar sections.

For purposes of the description presented herein, the term "line of disruption" can be used to generally refer to, for example, a cut line, a score line, a crease line, a tear line, or a fold line (or various sequential and/or overlapping combinations thereof) formed in a blank. A "breachable" line of disruption is a line of disruption that is intended to be breached during ordinary use of the carton. An example of a breachable line of disruption is a tear line.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. An enclosed carton having an interior surface; the carton being constructed from a major blank and at least one minor blank adhered to the major blank, and the at least one minor blank overlapping less than an entirety of the major blank, the major blank including top end flaps along a first marginal area and bottom end flaps along a second marginal area; the carton comprising:

a top closure formed by the top end flaps of the major blank at the first marginal area;

a bottom closure formed by the bottom end flaps of the major blank at the second marginal area;

a first side panel;

a second side panel;

a first end panel;

a second end panel, wherein the side and end panels, the top closure, and the bottom closure enclose and define in part an interior volume of the carton; and a liquid-tight vessel attached to at least a portion of the interior surface and lining at least a portion of the interior volume of the carton;

wherein the at least one minor blank comprises an upper minor blank adhered to the major blank adjacent to the top closure and a lower minor blank adhered to the major blank at the bottom closure, the upper minor blank has top end flaps that overlap the top end flaps of the major blank, and the lower minor blank has bottom end flaps that overlap the bottom end flaps of the major blank.

2. The carton of claim 1, wherein the vessel is adhered to the at least one minor blank.

3. The carton of claim 1, wherein the at least one minor blank is adhered to at least two of the first side panel, the second side panel, the first end panel, and the second end panel.

4. The carton of claim 1, wherein the at least one minor blank is adhered to the major blank between the bottom and top closures.

5. The carton of claim 1, wherein the vessel is adhered to the interior surface adjacent to the top closure.

6. The carton of claim 1, further comprising a tear strip, the tear strip at least partially defining a lid in the carton.

7. The carton of claim 6, wherein the tear strip extends around a periphery of the carton so that the lid is removable.

8. The carton of claim 6, wherein the tear strip extends around a part of the periphery of the carton so that the lid is pivotable.

9. The carton of claim 1, wherein the carton is parallelepipedal.

10. The carton of claim 1, further comprising at least one handle comprising a first handle feature extending in the major blank and a second handle feature extending in the minor blank, the second handle feature being generally aligned with the first handle feature.

11. The carton of claim 1 wherein each of the top end flaps of the upper minor blank and bottom end flaps of the lower minor blank overlap substantially the entirety of a respective top or bottom end flap.

12. The carton of claim 1 wherein each of the top end flaps of the upper minor blank overlap substantially the entirety of a respective top end flap of the major blank.

13. The carton of claim 12 wherein each of the bottom end flaps of the lower minor blank overlap substantially the entirety of a respective bottom end flap of the major blank.

14. An enclosed multi-ply carton constructed from a major blank and at least one minor blank and having an interior surface, the major blank including a first marginal area and a second marginal area; comprising:

a top closure formed by top end flaps of the major blank along the first marginal area;

a bottom closure formed by bottom end flaps of the major blank along the second marginal area;

a first side panel;

a second side panel;

a first end panel;

a second end panel, wherein the side and end panels, the top closure, and the bottom closure enclose and define in part an interior volume of the carton; and a liquid-tight vessel attached to at least a portion of the interior surface and lining at least a portion of the interior volume of the carton, wherein the at least one minor blank is adhered to at least two of the first side panel, the second side panel, the first end panel, and the second end panel; the at least one minor blank overlapping less than the entirety of the first side panel, the second side panel, the first end panel, and the second end panel, and the at least one minor blank comprises an upper minor blank adhered to the major blank adjacent to the top closure and a lower minor blank adhered to the major blank at the bottom closure, the upper minor blank has top end flaps that overlap the top end flaps of the major blank, and the lower minor blank has bottom end flaps that overlap the bottom end flaps of the major blank.

15. The carton of claim 14, wherein the at least one minor blank is adhered to the major blank between the bottom and top closures.

16. The carton of claim 14, wherein the vessel is adhered to the interior surface adjacent to the top closure.

17. The carton of claim 14, wherein the plurality of bottom flaps comprises:

a first side bottom flap; and a second side bottom flap.

18. The carton of claim 14, further comprising a tear strip.

19. The carton of claim 14, wherein the carton is parallelepipedal.

20. An article, comprising:

multi-ply blank comprising at least a major blank and at least one minor blank adhered to the major blank, a first side panel, a second side panel, a first end panel, and a second end panel comprising sections of the major blank; the major blank including top end flaps at a first marginal area and bottom end flaps at a second marginal area; the minor blank is adhered to at least two of the first side panel, the second side panel, the first end panel, and the second end panel; the minor blank overlapping less than the entirety of the first side panel, the second side panel, the first end panel, or the second end panel:

a bottom closure formed by at least partially overlapping the bottom end flaps at the second marginal area;

a top closure formed by at least partially overlapping the top end flaps at the first marginal area;

a first side panel;

a second side panel;

a first end panel;

a second end panel; and a liquid-tight vessel adhered to at least a portion of an interior surface of the blank; wherein the side and end panels, the top closure, and the bottom closure enclose and define at least in part an interior volume of the article;

wherein the at least one minor blank comprises an upper minor blank adhered to the major blank adjacent to the ton closure and a lower minor blank adhered to the major blank at the bottom closure, the upper minor blank has top end flaps that overlap the top end flaps of the major blank, and the lower minor blank has bottom end flaps that overlap the bottom end flaps of the major blank.

21. The article of claim 20, wherein the article is folded substantially flat.

22. The article of claim 20, wherein the article has a flat tubular form with the vessel located in an interior of the flat tubular form.

23. The article of claim 22, wherein one of the end panels is glued adjacent to one of the side panels.

24. The article of claim 20, wherein the side panels are substantially rectangular.

25. The article of claim 20, wherein at least one minor blank is adhered to the major blank between the bottom end flaps and the top end flaps.

26. The article of claim 20 wherein each of the top end flaps of the upper minor blank and the bottom end flaps of the lower minor blank overlap substantially the entirety of a respective top or bottom end flap.

27. The article of claim 20 wherein each of the top end flaps of the upper minor blank overlap substantially the entirety of a respective top end flap of the major blank.

28. The article of claim 27 wherein each of the bottom end flaps of the lower minor blank overlap substantially the entirety of a respective bottom end flap of the major blank.

29. A method of utilizing a multi-ply carton constructed from a major blank and at least one minor blank and having an interior surface, the major blank including top end flaps at a first marginal area and bottom end flaps at a second marginal area; the method comprising:

providing a carton, comprising:

a bottom closure formed by the bottom end flaps of the major blank along the second marginal area;

a top closure formed by the top end flaps of the major blank along the first marginal area;

a first side panel;

a second side panel;

a first end panel;

a second end panel, wherein the side and end panels, the top closure, and the bottom closure enclose and define in part an interior volume of the carton; and a liquid-tight vessel attached to at least a portion of the interior surface and lining at least a portion of the interior volume of the carton;

the at least one minor blank is adhered to at least two of the first side panel, the second side panel, the first end panel, and the second end panel; the minor blank overlapping less than the entirety of the first side panel, the second side panel, the first end panel, or the second end panel, and the at least one minor blank comprises an upper minor blank adhered to the major blank adjacent to the top closure and a lower minor blank adhered to the major blank at the bottom closure, the upper minor blank has top end flaps that overlap the top end flaps of the major blank, and the lower minor blank has bottom end flaps that overlap the bottom end flaps of the major blank;

closing the top closure of the carton by inwardly folding the top end flaps that are overlapped by a respective top end flap of the upper minor blank;

opening the top closure of the carton; and expanding the interior volume of the carton by at least partially unfolding the at least one minor blank to define an upper portion of the at least one minor blank.

30. The method of claim 29, wherein opening a top portion of the carton comprises tearing at least one tear feature in the carton.

31. The method of claim 29, wherein the carton is substantially parallelepipedal.

32. The method of claim 29 wherein each of the top end flaps of the upper minor blank and bottom end flaps of the lower minor blank overlap substantially the entirety of a respective top or bottom end flap.

33. The method of claim 29 further comprising closing the bottom closure of the carton by inwardly folding the bottom end flaps of the major blank that are overlapped by a respective bottom end flap of the minor blank.

* * * * *